US006253843B1

(12) United States Patent
Rawson et al.

(10) Patent No.: US 6,253,843 B1
(45) Date of Patent: Jul. 3, 2001

(54) ELECTRIC SAFETY VALVE ACTUATOR

(75) Inventors: Michael S. Rawson, Tulsa; Doug Trott, Coweta, both of OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 08/987,686

(22) Filed: Dec. 9, 1997

Related U.S. Application Data

(60) Provisional application No. 60/032,932, filed on Dec. 9, 1996.

(51) Int. Cl.[7] ..... E21B 34/00

(52) U.S. Cl. ..... 166/66.7; 166/332.8

(58) Field of Search ..... 166/66.6, 66.7, 166/330, 332.8; 251/89, 129.11, 266, 339

(56) References Cited

U.S. PATENT DOCUMENTS

| | | | | |
|---|---|---|---|---|
| 3,007,669 | * | 11/1961 | Fredd | 251/58 |
| 3,860,066 | * | 1/1975 | Pearce et al. | 116/72 |
| 3,861,464 | * | 1/1975 | Boyadjieff et al. | 166/224 A |
| 4,002,202 | * | 1/1977 | Huebsch et al. | 166/65 M |
| 4,566,534 | * | 1/1986 | Going, III | 166/66.4 |
| 4,579,177 | | 4/1986 | Going, III | 166/66.5 |
| 4,768,539 | * | 9/1988 | Pringle | 137/70 |
| 4,796,708 | * | 1/1989 | Lembcke | 166/386 |
| 4,886,114 | | 12/1989 | Perkins et al. | 166/66.7 |
| 4,896,722 | * | 1/1990 | Upchurch | 166/250 |
| 4,951,753 | * | 8/1990 | Eriksen . | |
| 5,070,944 | | 12/1991 | Hopper | 166/66.7 |
| 5,343,955 | * | 9/1994 | Williams . | |
| 5,862,864 | * | 1/1999 | Whiteford | 166/321 |

* cited by examiner

*Primary Examiner*—David Bagnell
*Assistant Examiner*—Sunil Singh
(74) *Attorney, Agent, or Firm*—Cantor Colburn LLP

(57) ABSTRACT

An electric safety valve actuator for a surface controlled subsurface safety valve. The actuator includes a motor drive and driver selectively coupled with a drive yoke connected to an otherwise conventional flow tube of a downhole safety valve.

12 Claims, 23 Drawing Sheets

ELECTRIC SAFETY VALVE ACTUATOR

CROSS REFERENCE TO RELATED APPLICATION

This application claims priority to U.S. Provisional Application Ser. No. 60/032,932 filed Dec. 9, 1996.

BACKGROUND OF THE INVENTION

1. Field of the Invention

The invention relates to a surface controlled subsurface safety valve (SCSSV) for a sub-terranean well and, more particularly, to a safety valve utilizing an electrical actuation mechanism controlled from the surface or by a downhole intelligent controller.

2. Prior Art

Employment of a downhole safety valve is well known for subterranean oil and gas wells. Such valves, which can comprise a plug or pocket type, a sleeve valve, a flapper valve or ball valve, are normally positioned downhole to close the bore of the tubing string leading from one or more production zones to the well surface. Safety valves of this type are normally biased to a fail safe condition whereby any significant reduction in the opening force acting upon a valve will allow a pre-energized arrangement such as a spring to close the valve.

Commonly, downhole safety valves are actuated by hydraulics. A hydraulic system is connected to a piston arrangement; pressure from the surface via a small diameter control line is directed upon the piston which, in turn, moves a flow tube past a flapper valve thereby opening the flapper valve. In this position the flapper is essentially locked in the open position by the presence of the flow tube. A spring is generally placed in contact with the flow tube and with a non-moveable housing so that when the flow tube is urged downhole it is against the bias of the spring, thus energizing the spring for closing of the valve should the opening impetus caused by the hydraulic pressure from above be lost or reduced. While these valves are highly effective in the field, they do have drawbacks. One such drawback is that since these valves are installed many thousands of feet below the earth's surface, thus necessitating many thousands of feet of hydraulic control line, the hydrostatic pressure of the control line is sufficient to render the closing of the safety valve a slow process. In order to close the valve, the spring must lift the hydraulic column all of the fluid contained in the piston cylinder back into the control line by forcing, for instance, six thousand feet of fluid in that control line uphole. This requires a strong closure spring to lift the hydraulic fluid column. Necessarily, the control line is susceptible to damage during the running process and the joints in the control line may develop leaks over time. Such a leak would indicate a reduction in the opening impetus and the fail safe feature of the valve would close the same. Loss of integrity of the control line, in general, requires that the entire tubing string be pulled from the well and necessary repairs made.

More recently electric actuation of downhole safety valves has become of interest. Electrically operated safety valves are becoming increasingly popular with the introduction of intelligent downhole systems such as those disclosed in U.S. patent application Ser. No. 08/386,504 now U.S. Pat. No. 5,706,896 assigned to the assignee hereof and incorporated herein by reference. Downhole intelligence allows an electrically actuated downhole safety valve to receive commands from the surface or downhole and thereby operate either completely automatically or with input if desired.

One of the drawbacks associated with the use of solenoid actuated downhole safety valves arises from the use of the solenoid itself to directly open the valve. Opening valves of larger sizes requires a reasonably long throw. Solenoids, however, generally operate on throws shorter than that necessary. In many cases the throw of the solenoid is not sufficient to completely open the safety valve. This impedes flow of production fluid and risks damage to the safety valve due to the bending moment on the pivot point of the valve caused by production flow. To remedy the drawback, either a larger solenoid or various levering arrangements have been employed with some success. There is still a need, however, for improved methods of electrically actuating the downhole safety valve.

SUMMARY OF THE INVENTION

The above-discussed and other drawbacks and deficiencies of the prior art are overcome or alleviated by the electrically actuated downhole safety valve of the invention.

The invention employs a rotational motor and lead screw to interact with an engageable yoke which moves the flow tube. Extending around the I.D. of the housing is an engageable and disengageable yoke similar to a half nut which when engaged is moveable along the lead screw. The yoke is also attached to a flow tube which is disposed within the I.D. of the yoke such that upon engagement of the yoke with the lead screw and the movement imparted to the yoke is also imparted to the flow tube. As the flow tube is urged toward and through the flapper valve, it is aligned with and connects with the downhole production tube.

In order to actuate the yoke of the invention, a solenoid is connected to a camming rod which urges the yoke apart at one point thereof and together at a point diametrically opposed to the first point. This allows engagement of the yoke with the lead screw at the second point. As will be understood by one of skill in the art in order to provide such movement the yoke is divided in two parts (half yokes) and mounted on guide rods. Therefore, separation of the half yokes at one end will produce the movement of the other ends of the half yokes closer together and thus into communication with the lead screw.

In another aspect of the invention the friction commonly associated with a half nut for a lead screw is avoided by providing follower screws mounted on bearings and connected to the engagement side of the yoke. Since frictional characteristics are dramatically reduced the effective power requirement of the rotational motor need not be as high as it otherwise might have to be. Several embodiments of actuation mechanisms and particular assemblies are discussed in detail in the pages following.

The yoke and lead screw design of the present invention replace the hydraulic actuation of the prior art shown in FIG. 1 while other aspects of the safety valve remain the same as the prior art.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENT

Figure 1:
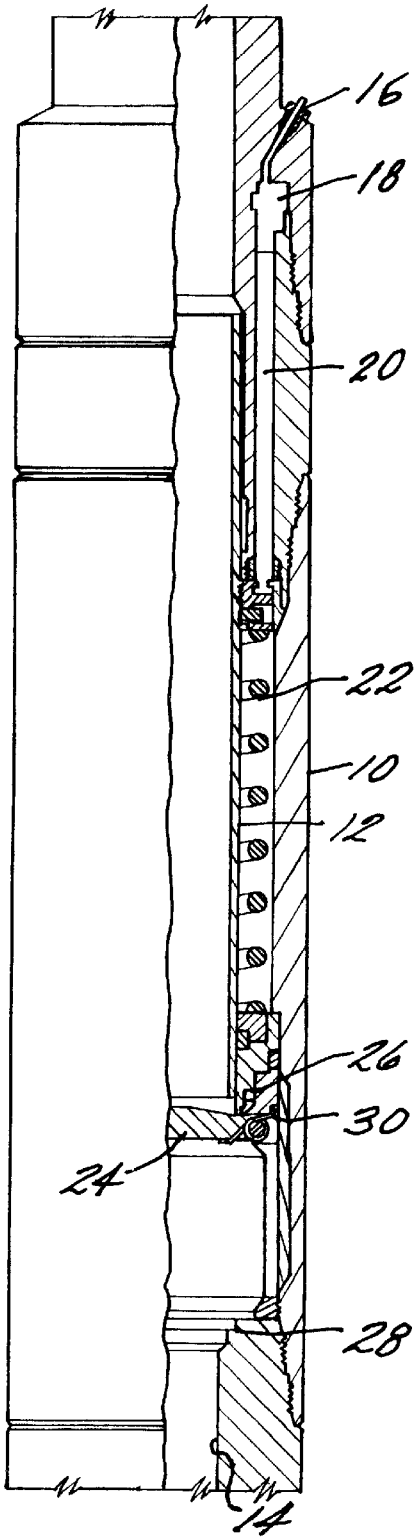
FIG. 1 (PRIOR ART)
FIG. 1 is a view of the prior art hydraulic safety valve.

Referring to FIG. 1, which is a representation of a prior art hydraulically actuated safety valve available from Baker Oil Tools, Broken Arrow, Okla., housing 10 surrounds the production pipe including an axially moveable flow tube 12 and fixed flow pipe 14. Actuation of the system, as will be recognized by one of skill in the art is by a hydraulic control line (not shown) attached to the safety valve assembly at connector 16 providing hydraulic fluid to chamber 18 which provides the impetus to piston 20 to move downhole taking with it flow tube 12 and compressing power spring 22 in the process. Flapper valve 24 is urged into the open position by the downhole movement of flow tube 12 and is, in fact, forced completely out of the path of flow tube 12 such that end 26 of flow tube 12 will seat in shoulder 28 of the fixed pipe 14. This provides a smooth flow bore from below to above the safety valve. Upon a loss of pressure in chamber 18, spring 22 will urge piston 20 back uphole along with flow tube 12 and will thus allow flapper valve 24 to close due to flow and, in addition, the urging of flapper spring 30.

Due to the inherent drawbacks of the hydraulically actuated safety valve noted above, the invention replaces the hydraulic actuation system and piston with a rotational motor and a novel mechanism to translate the rotational movement of the lead screw to the flow tube. In other respects, the safety valve of the invention is similar to the prior art.

It should be noted that in addition to the inherent drawbacks of the hydraulically actuated systems in the prior art, another driving force behind the interest in moving to electrically operated systems is the increasingly ubiquitous use of downhole intelligent systems and surface to downhole communication systems. Although one embodiment of the invention employs a hard wired electrical supply line to the surface, downhole intelligence allows for control of this line downhole and additionally allows for the use of alternate downhole power supply systems and therefore can avoid some of the inherent drawbacks of going to the surface.

Figure 2A:
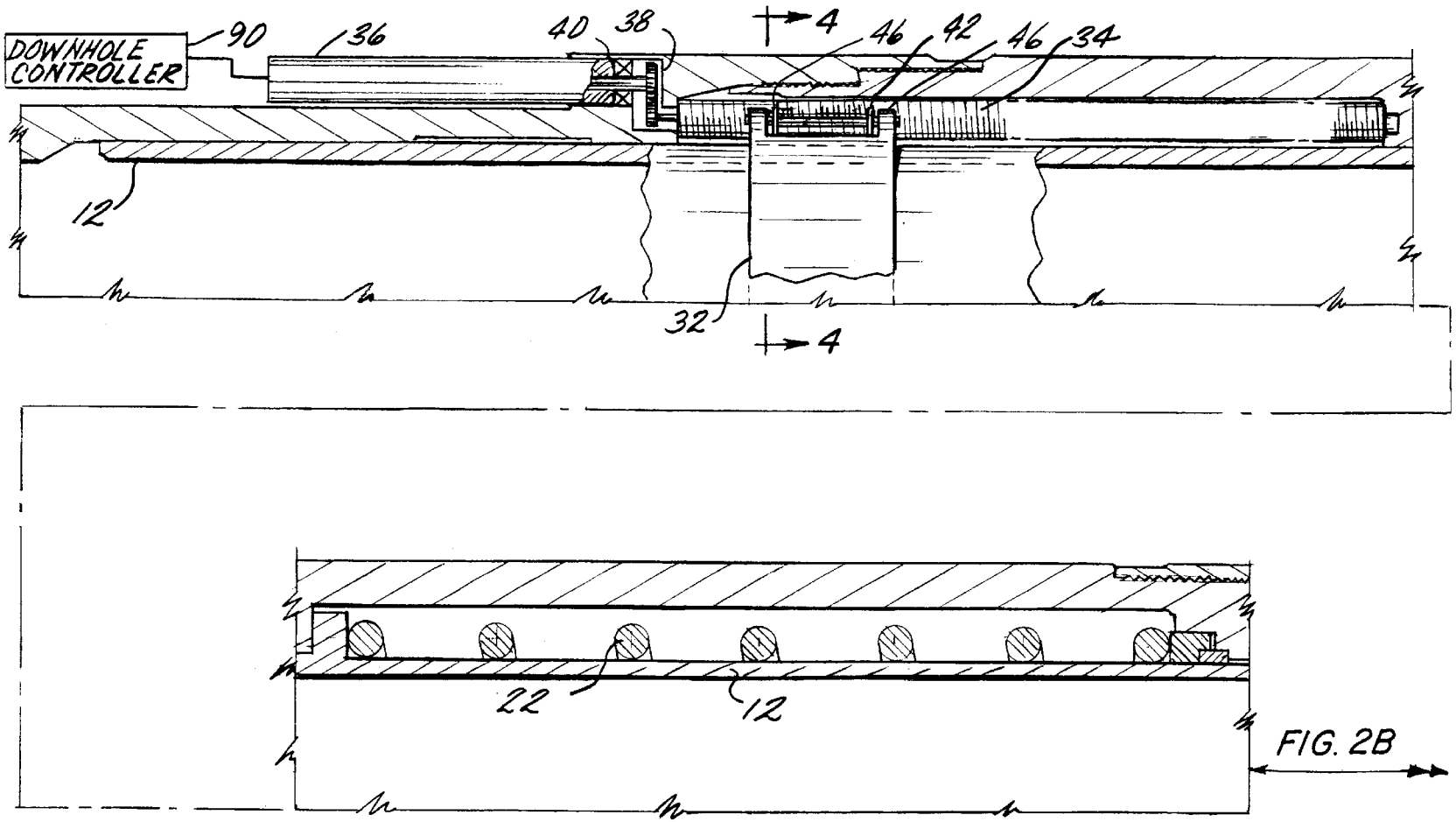
FIGS. 2A and 2B are a cross-section of one embodiment of the invention wherein the valve closed.
Figure 2B:
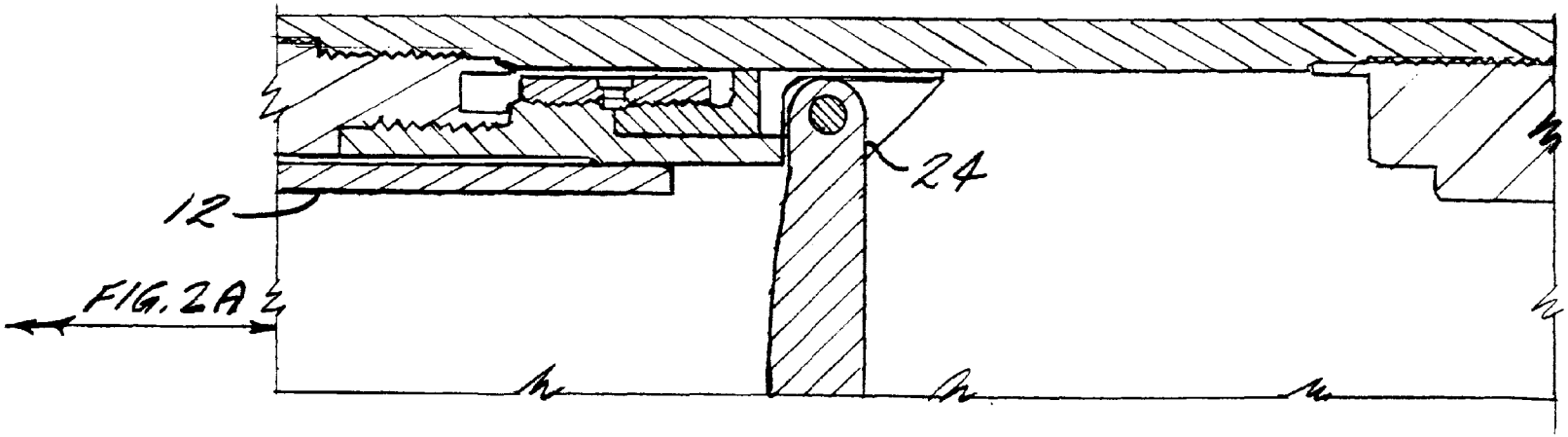
Figure 3A:
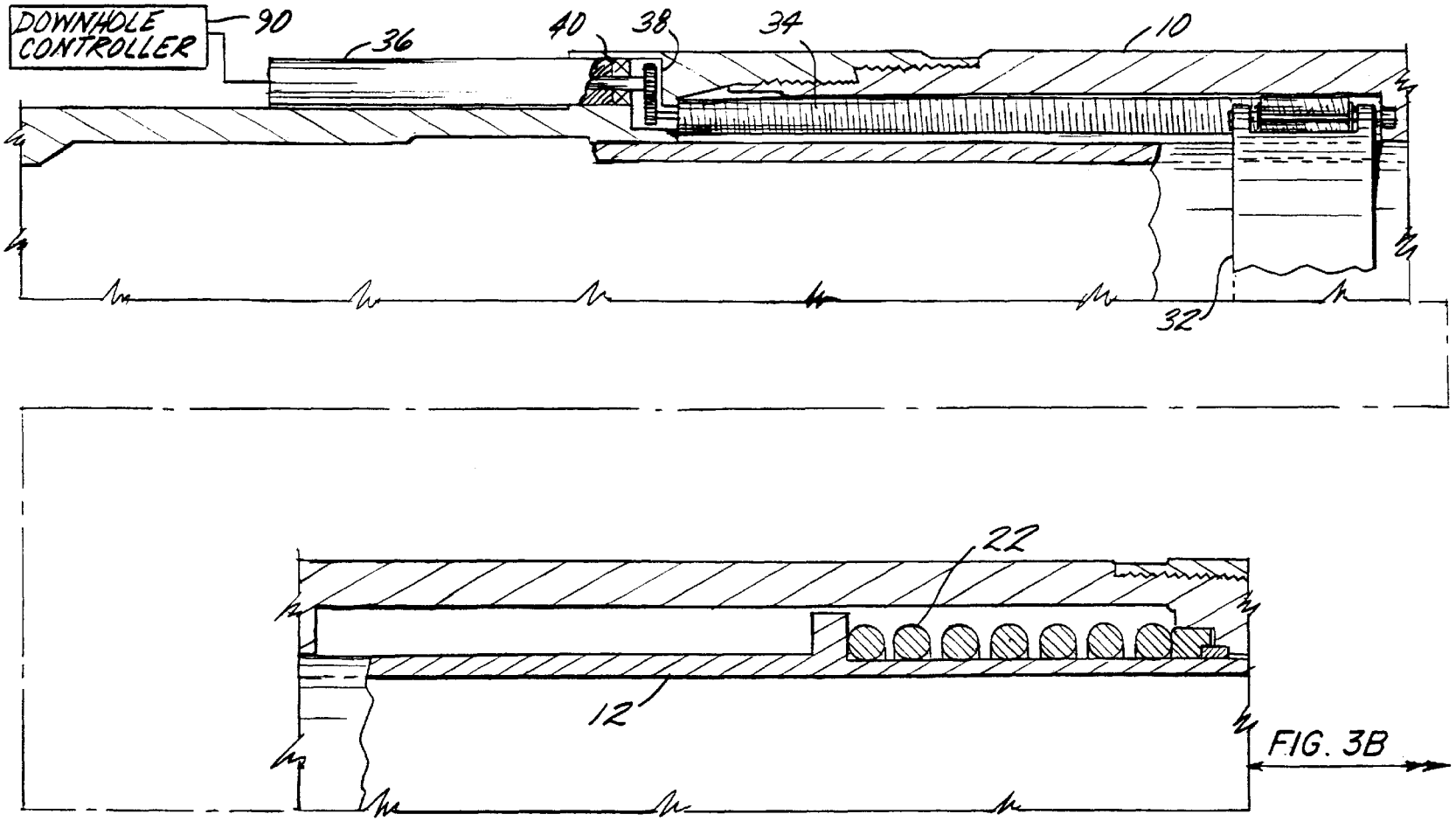
FIGS. 3A and 3B is a quarter section of the invention wherein the safety valve is open.
Figure 3B:
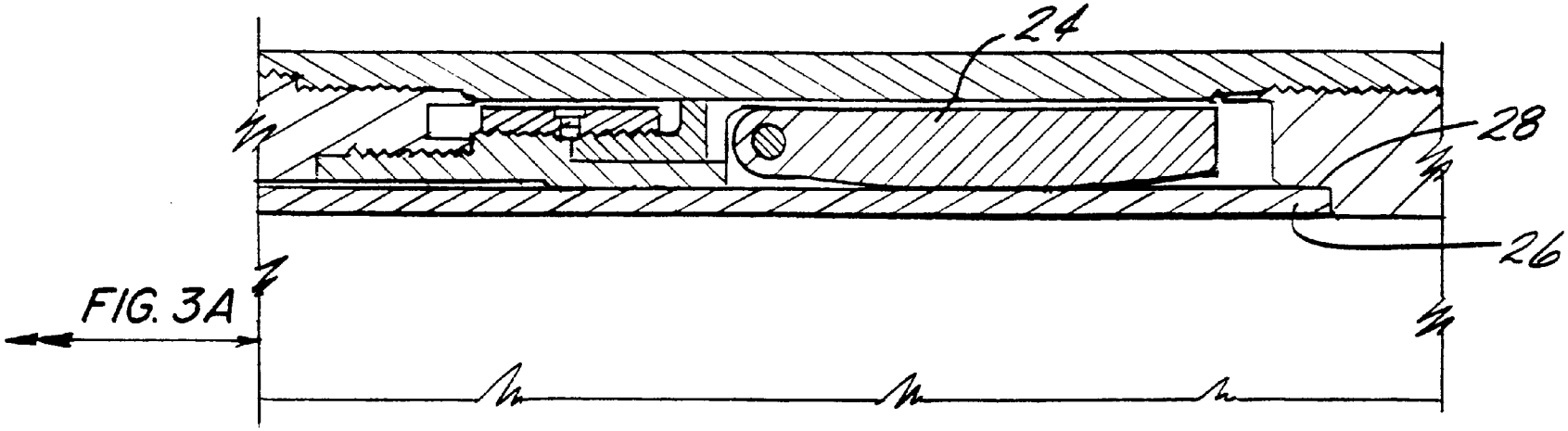

Referring to FIGS. 2A and 2B, it will be appreciated that the valve is in the fail-safe, closed position. In this position, as will be understood, the yoke 32 of the invention is illustrated at an uphole end of the lead screw 34. In order to actuate the safety valve the yoke and flow tube will be moved downhole. The instruction to actuate the safety valve may be provided from a surface controller or a downhole controller 90 shown in FIG. 2A. Upon actuation of the rotational motor 36, turning gears 38 and consequently gear 40, lead screw 34 is turned. When yoke 32 is actuated by a solenoid and cam, to place follower screws 42 in contact with lead screw 34, yoke 32 will be urged downhole along with flow tube 12 to compress spring 22 and open flapper valve 24 as in the prior art. Viewing FIGS. 2A and 2B and 3A and 3B sequentially will provide an illustration of the tool prior to actuation (valve closed) and after actuation (valve open). Upon any loss of power, the solenoid will allow the cam 50 to rotate to the resting position and disengage yoke 32. Immediately upon yoke 32 disengaging screw 34, there is nothing restricting extension of spring 22 back toward its resting length. Spring 22 will thus move flow tube 12 and yoke 32 uphole. As the flow tube 12 is withdrawn from the position where it interferes with the closing of flapper valve 24, the valve will shut due to fluid flowing there past and to the flapper spring 30. This is the fail-safe position of the device of the invention and is illustrated in FIGS. 2A and 2B. The fail-safe position is that of the unactuated position as well.

Figure 4A:
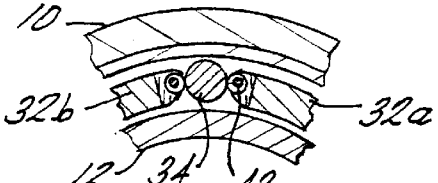
FIG. 4A is a view of the invention taken along section line 4*a* in FIG. 4 without rockers with twin follow screws but with merely with a single follower screw on each half yoke.
Figure 4:
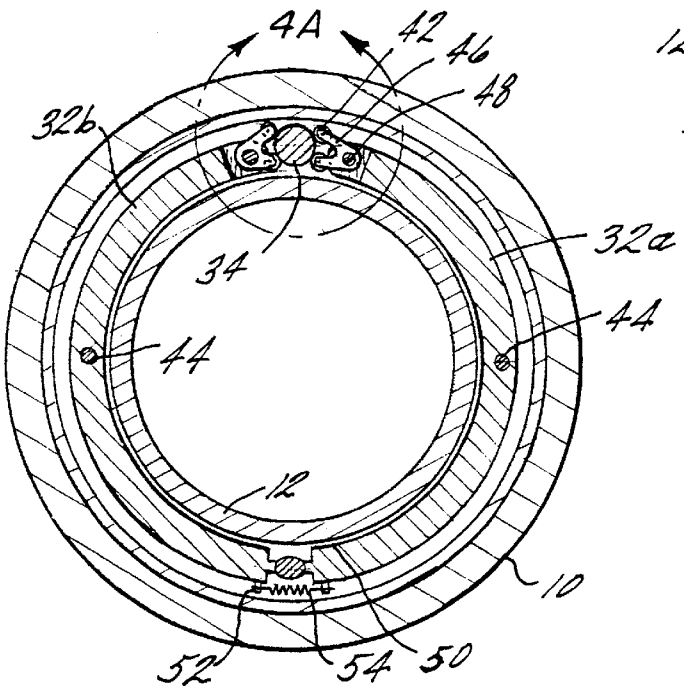
FIG. 4 is a cross-section view from FIG. 2A taken along section lines 4—4.

Referring more specifically to the yoke of the invention, attention is directed to FIG. 4 which is a cross-section taken from FIG. 2A wherein a plan view of the yoke illustrates the operation thereof. Yoke 32 is actually broken in two sections which will be referred to as yoke halves 32*a* and 32*b*. Each section is mounted on a guide rod 44 at about the mid-point between the operative ends of yoke halves 32*a* and 32*b*. For purposes of discussion, the orientation of parts in the FIGURE, such as top, bottom and sides will be referred to. It will be understood that apart from the discussion of the various parts in relation to one another, these terms do not have any meaning. As one of skill in the art will readily appreciate, "bottom" in the drawing is not actually a bottom of the device but merely illustrated at the bottom of the drawing. Referring to the top of drawing FIG. 4, lead screw 34 is illustrated in cross-section and has been contacted by follower screws 42 on rocker arms 46 which pivot on pins 48 mounted in the top of each yoke half 32*a* and 32*b*. It can be ascertained from the drawing that the top of yokes 32*a* and 32*b* are moved toward one another and into contact with lead screw 34 by moving the bottom of each of yoke half 32*a* and 32*b* apart from one another. Moving the bottom ends of yoke half 32*a* and 32*b* apart pivots each yoke half on respective guide rods 44 to effect the desired result at the top of the drawing. In the most preferred embodiment of the invention an oval cam 50 is mounted between yoke extensions 52 of each yoke half 32*a* and 32*b*. Cam 50 is actuated by an electrically powered solenoid (not shown) which turns the cam a sufficient amount to bring roller screws 42 into engagement with lead screw 34. The cam is also spring loaded such that upon a failure of power to the solenoid, the cam will spring back to its disengaged position allowing follower screws 42 to disengage from lead screw 34. At this instant, the action of spring 22, as described above, is effected.

Figure 5:
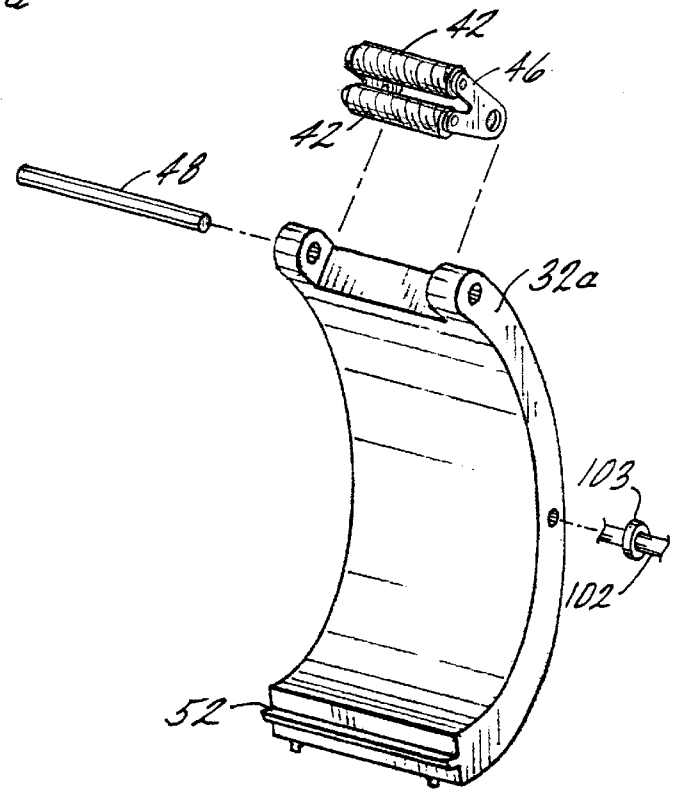
FIG. 5 is a perspective view of one half yoke of the invention.

Referring more particularly to the circumscribed section 4*a* in FIG. 4 and to FIG. 5 one preferred embodiment is illustrated wherein four follower screws 42 are employed. In FIG. 4A, an alternate embodiment is illustrated wherein only two follower screws are employed. This arrangement replaces a half nut which would otherwise be employed to follow a lead screw design. The half nut, however, adds friction which requires additional rotational power to turn the lead screw and increases the wear on components of the device such that earlier replacement is required. In the invention, either a four follower screw arrangement or a two follower screw arrangement is employed, as desired, wherein the follower screws are threaded complimentarily to the pitch of the lead screw and are mounted on bearings either at the tops of yoke halves 32*a* and 32*b* as illustrated in FIG. 4A or in the rockers 46 as illustrated in FIG. 4. The follower screws provide very little friction on a lead screw both because they contact the lead screw at discrete portions and not all the way around ( as does a half nut) and because they are not static but roll on the bearings with the movement of lead screw 34. With this arrangement virtually all significant frictional forces are alleviated. Power of the rotational motor 36 and longevity of the arrangement of the invention are reduced and increased, respectively. It will be understood that disengagement of the follower screws 42 from lead screw 34 is accomplished by moving them the distance of the thickness of the threads and slightly beyond to completely disengage from the lead screw. Movement of the yoke halves more than necessary is contraindicated.

Referring to the bottom of FIG. 4, the cam 50 is illustrated in the engaged position and disengagement spring 54 is illustrated in the extended position. Upon movement of the cam 50 pursuant to a loss of power in the solenoid, spring 54 will draw the bottom ends of each yoke half 32*a* and 32*b* toward one another and consequently pull the top ends of yoke halves 32*a* and 32*b* away from one another, thus, disengaging the follower screws from the lead screw. As shown in FIG. 5, each yoke half 32*a* and 32*b* ride on guide rods 102 and push on a bearing 103 positioned around the guide rod 102. Below the yoke 32, the flow tube 12 has an increased outer diameter to form a shoulder. The outer diameter at the flow tube shoulder is greater than the outer diameter of the yoke 32. As the yoke 32 moves, it engages the shoulder 140 (shown in FIG. 10) of the flow tube 12 and consequently moves the flow tube 12.

Figure 6:
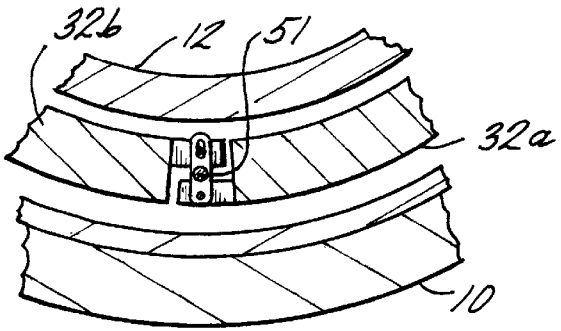
FIG. 6 is an alternate embodiment of the bottom section of FIG. 4 and illustrated in the disengaged position.
Figure 7:
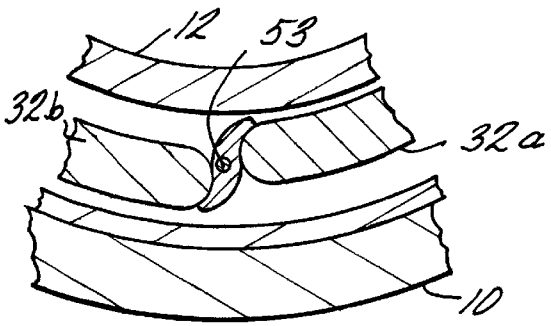
FIG. 7 is another alternate embodiment of the bottom section of FIG. 4 and illustrated in the disengaged position.

Referring to FIGS. 6 and 7, alternate embodiments of the cam at the bottom of drawing 4 are illustrated. Movement of each of the cams 51 and 53 respectively, most preferably, is sufficient to cause engagement of the follower screws with lead screw 34 within a few degrees of movement. One of ordinary skill in the art then will clearly understand the alternative embodiments illustrated in FIGS. 6 and 7 from a brief perusal thereof in connection with the understanding of the invention gained from this disclosure.

Figure 8:
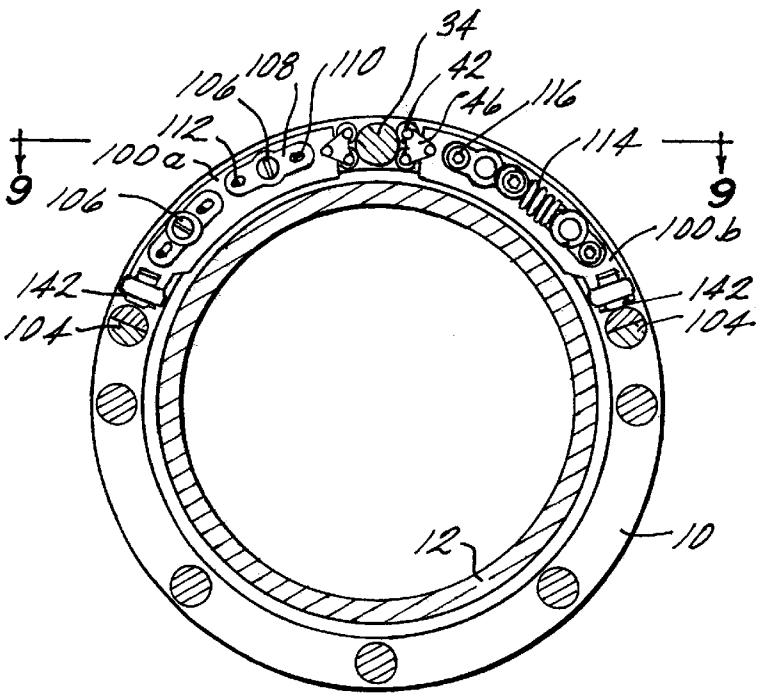
FIG. 8 is a cross-sectional end view of yet another alternative embodiment in a disengaged position.

Another alternative embodiment is shown in FIGS. 8–13. The embodiment shown in FIGS. 8–13 operates in a similar manner as the embodiments previously described in that a yoke engages a lead screw and pushes the flow tube to open a flapper valve. FIG. 8 is a cross-sectional end view of the alternative embodiment in a disengaged position. The embodiment shown in FIG. 8 includes two yoke halves 100*a* and 100*b*. At one end of each yoke half are follower screws 42 mounted to rocker arm 46 as described previously. The other end of each yoke half rides on a split rod 104 through a roller assembly 142. As will be described below, the split rods 104 force each yoke half 100*a* and 100*b* towards the lead screw 34 so that the follower screws 42 engage the lead screw 34. Each yoke half includes openings for receiving guide rails 106 that engage bushings 108. Each opening in the yoke 100 that receives a guide rail 106 has a dimension greater than the O.D. of each guide rail 106 so that the yoke 100 can move radially with respect to the guide rails. At each end of each bushing 108, a slot 110 is formed. Tap holes 112 are aligned with each slot 110 and are shown in FIG. 8 on yoke half 100*a*. Yoke half 100*b* shows bolts 116 that pass through the slot 110 and connect to the tapped holes 112. The bolt 116 is dimensioned so slot 110 freely moves around bolt 116. This configuration allows the yoke halves 100*a* and 100*b* to move radially and axially relative to the guide rails 106.

Figure 9:
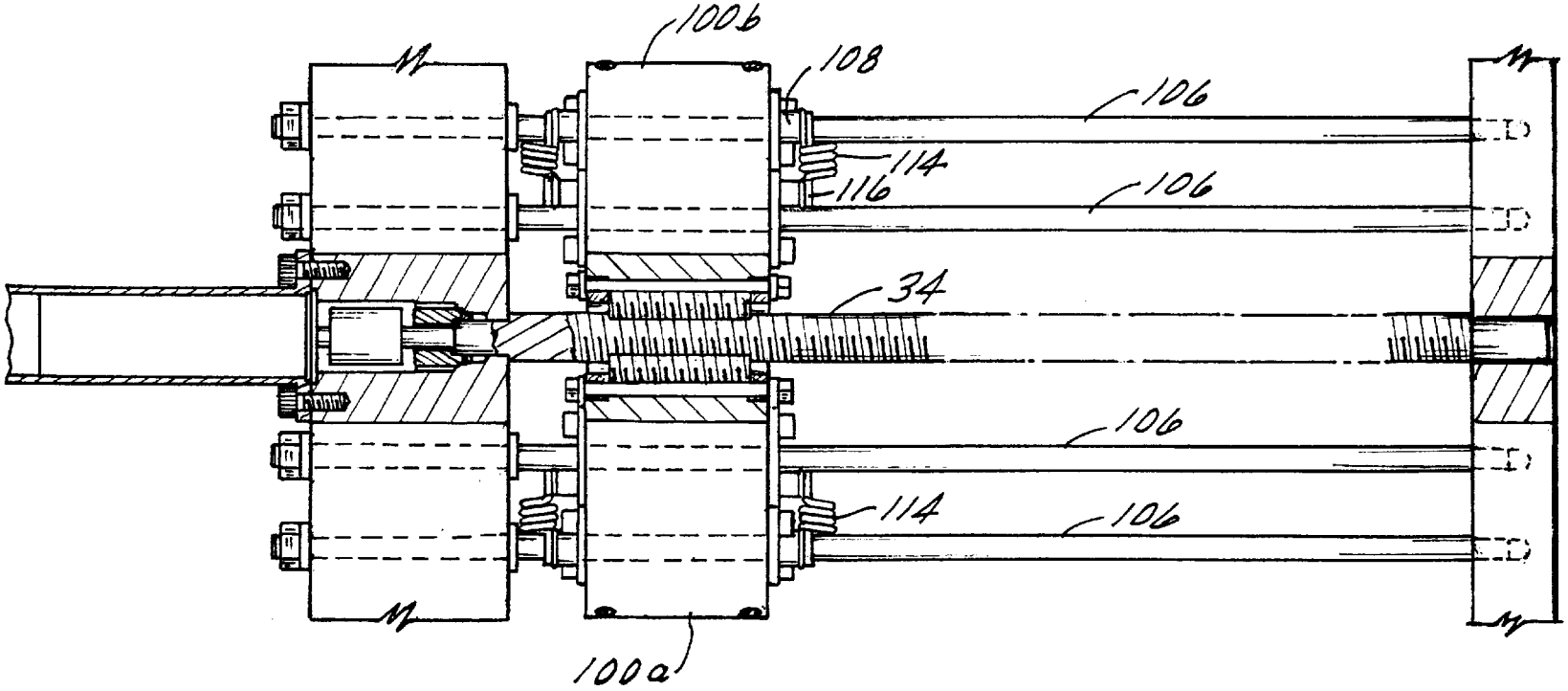
FIG. 9 is a cross-sectional top view of the embodiment shown in FIG. 8 in a disengaged position.

Springs 114 are connected to the bushing 108 around one of the guide rails 106 and to one of the bolts 116. The bolt that receives the spring 114 may have an enlarged height to facilitate connecting the spring 114 to bolt 116. Springs 114, shown in yoke half 100*b*, pull the yoke halves 100 away from the lead screw 34 in the event that the power to the electric safety valve is interrupted. It is understood that yoke half 100*a* is completed in the same manner as yoke half 100*b* and is shown partially completed to provide a detailed description. FIG. 9 is a cross-sectional top view of the embodiment shown in FIG. 8 showing both yoke halves 100*a* and 100*b* fully completed.

Figure 10:
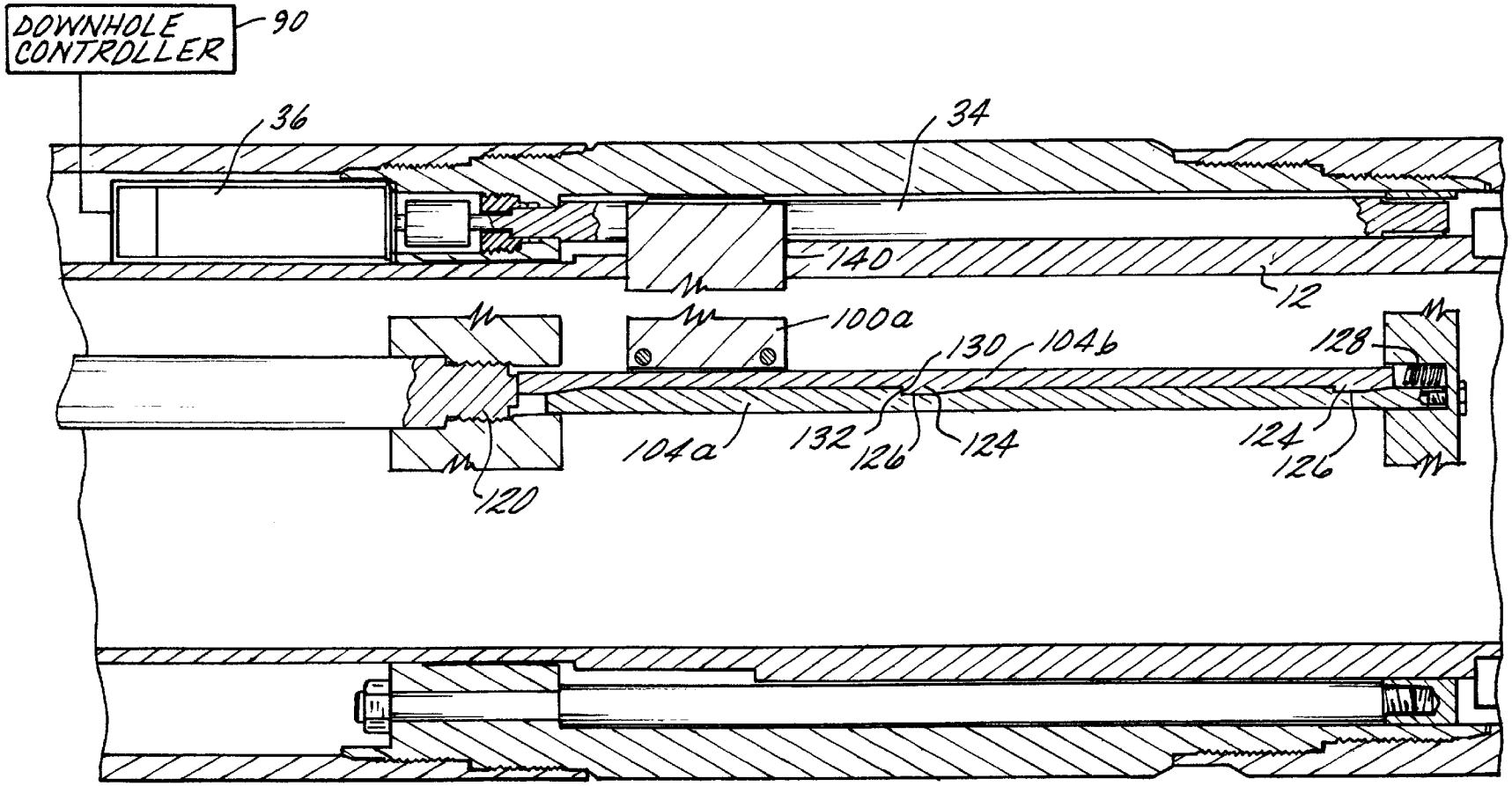
FIG. 10 is a cross-sectional side view of the embodiment shown in FIG. 8 in a disengaged position.

FIG. 10 is a cross-sectional side view of the embodiment shown in FIG. 8 in the disengaged position. The split rod 104 is made up of two portions 104*a* and 104*b*. Rod portion 104*a* includes recess 126 and rod portion 104*b* includes protrusions 124 that engage recesses 126. When the protrusions 124 and placed in recesses 126, the inside surfaces of rod portions 104*a* and 104*b* are flush and proximate to each other. A solenoid 120 includes a solenoid arm 122 (shown in FIG. 13) the shifts rod portion 104*b* relative to rod portion 104*a*. This causes the protrusions 124 to ride out of the recesses 126 and contact the interior surface of rod portion 104*a*. The rod portions 104*a* and 104*b* are spread apart. When power to solenoid 120 is discontinued, the solenoid arm 122 retracts into the solenoid 120. Spring 128 positioned at one end of rod portion 104*b* shifts rod portion 104*b* so that protrusions 124 are positioned in recesses 126. The spring 128 returns that yoke to the disengaged (fail-safe) position should power to the solenoid be interrupted. The protrusions 124 include a surface 130 that contacts a shoulder 132 formed in recess 126 to limit the travel of rod portion 104*b* relative to rod portion 104*a*.

Figure 11:
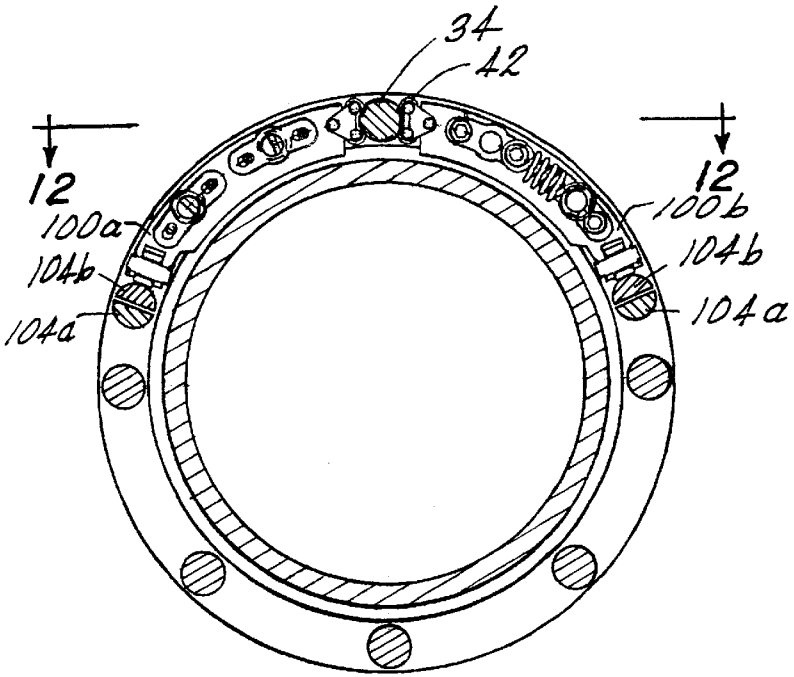
FIG. 11 is a cross-sectional end view of the embodiment shown in FIG. 8 in an engaged position.
Figure 12:
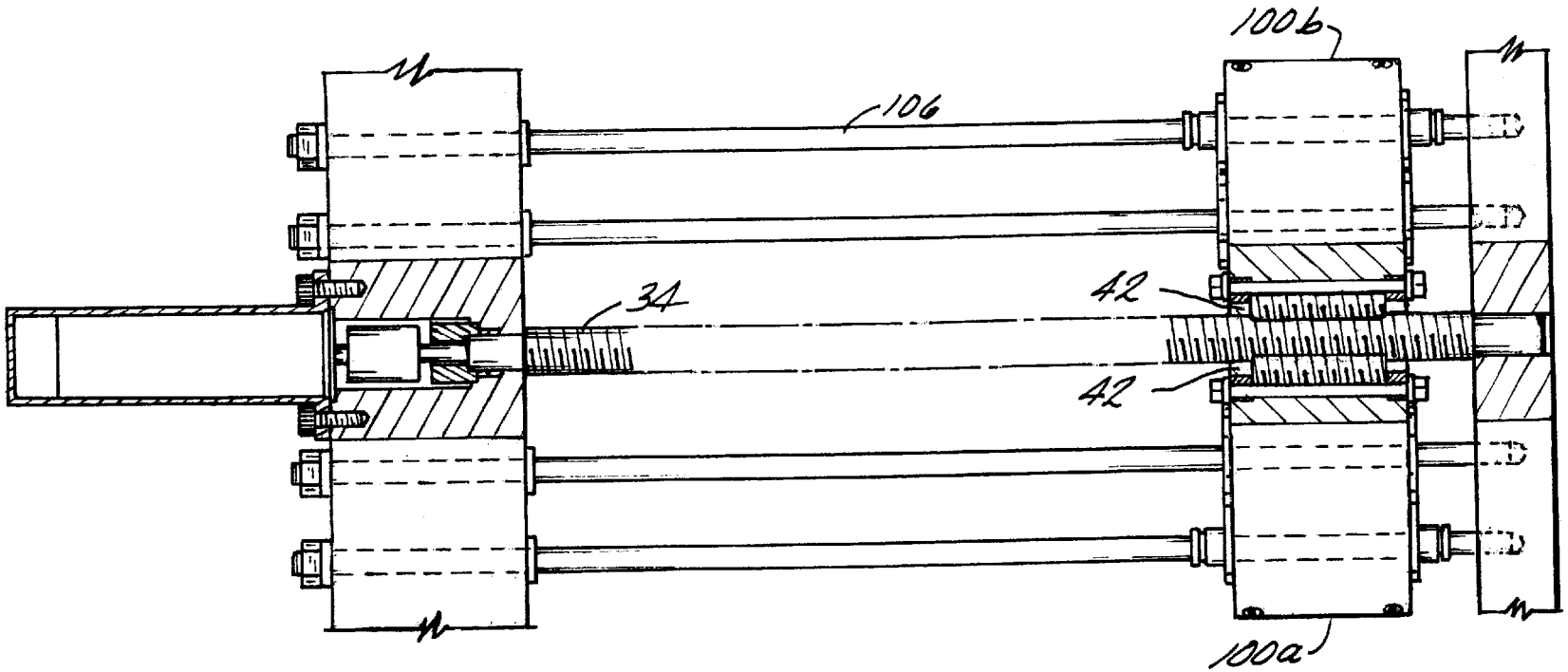
FIG. 12 is a cross-sectional top view of the embodiment shown in FIG. 8 in an engaged position.

FIG. 11 is a cross-sectional end view of the embodiment shown in FIG. 8 in the engaged position. The rod portions 104*a* and 104*b* are spread apart thereby forcing the yokes halves 100*a* and 100*b* towards the lead screw 34. The follower screws 42 engage lead screw 34. The yoke 100 may now be moved by motor 36 thereby moving flow tube 12 as previously described. As shown in FIG. 12, the yoke 100 has traveled along the guide rails 106 through the interaction of lead screw 34 and follower screws 42.

Figure 13:
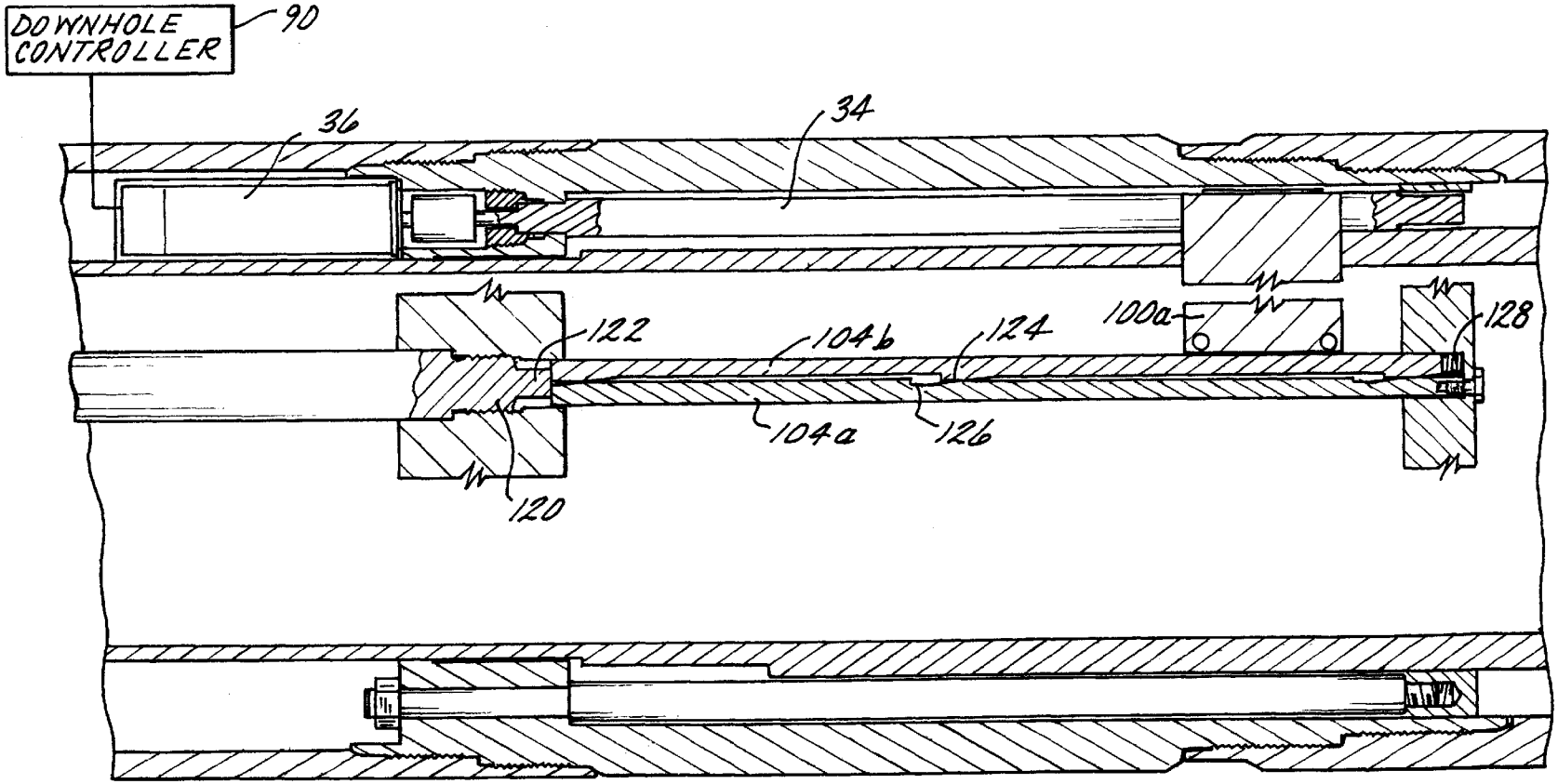
FIG. 13 is a cross-sectional side view of the embodiment shown in FIG. 8 in an engaged position.
Figure 14:
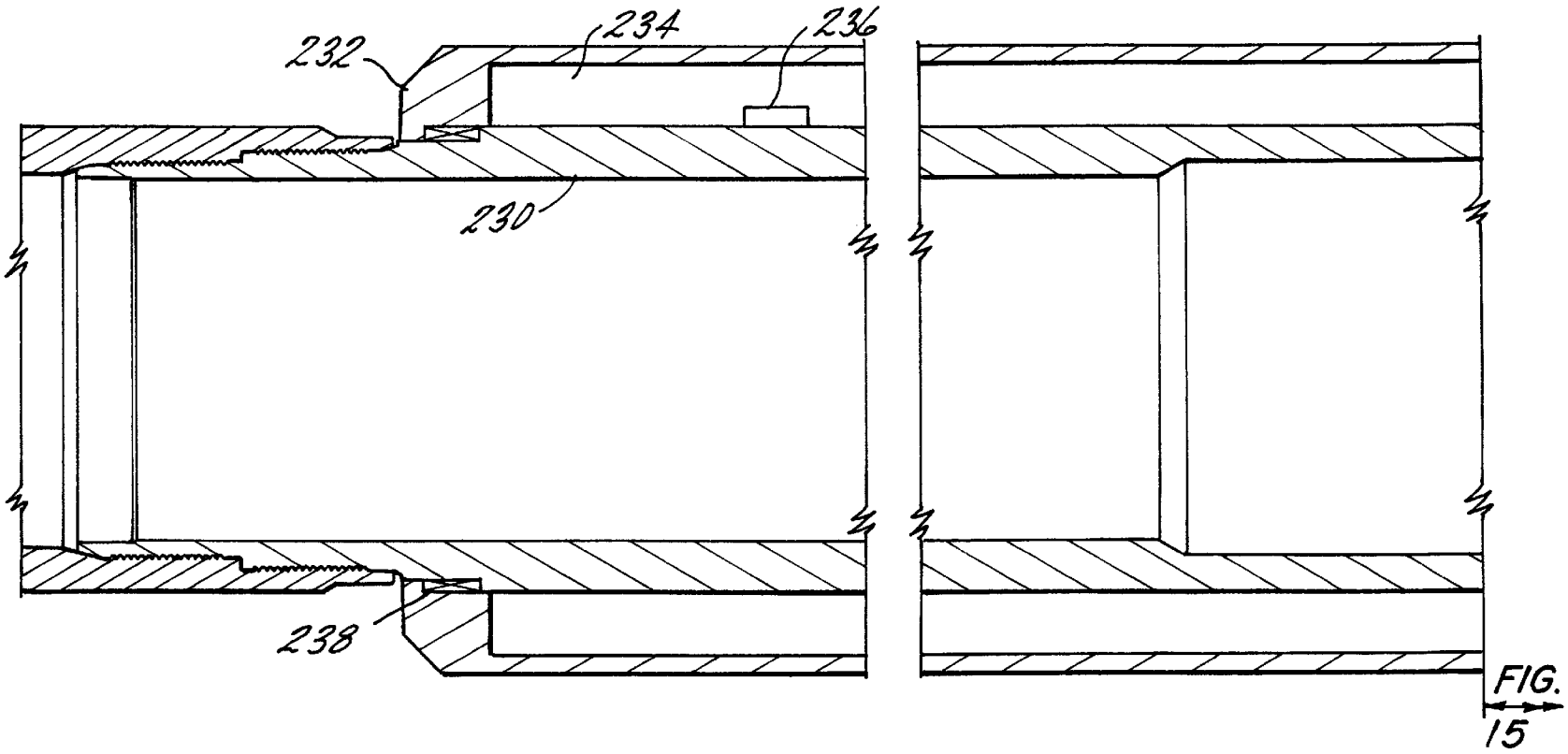
FIGS. 14–18 are an elongated view of an alternate embodiment of the invention.
Figure 15:
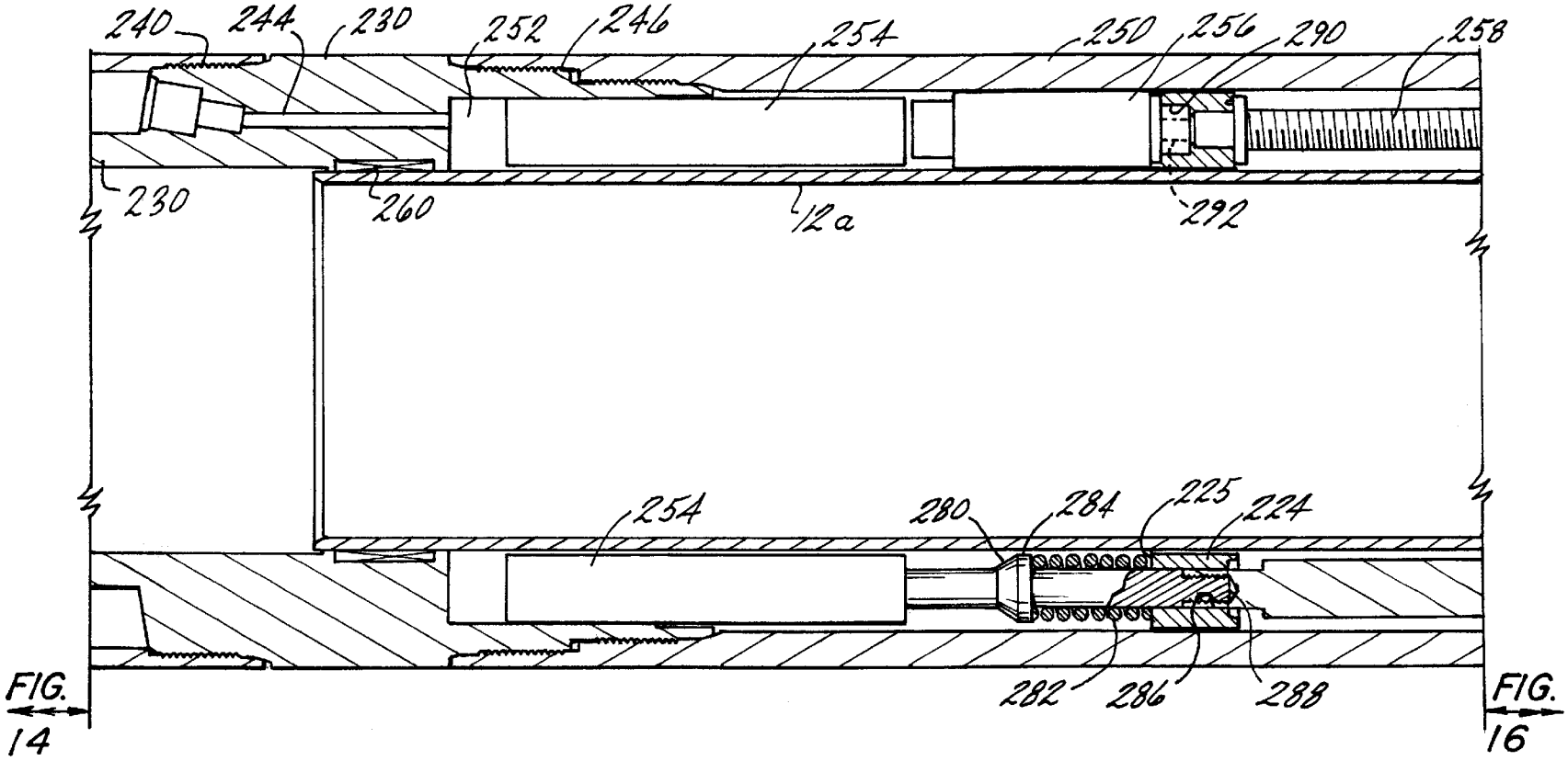
Figure 16:
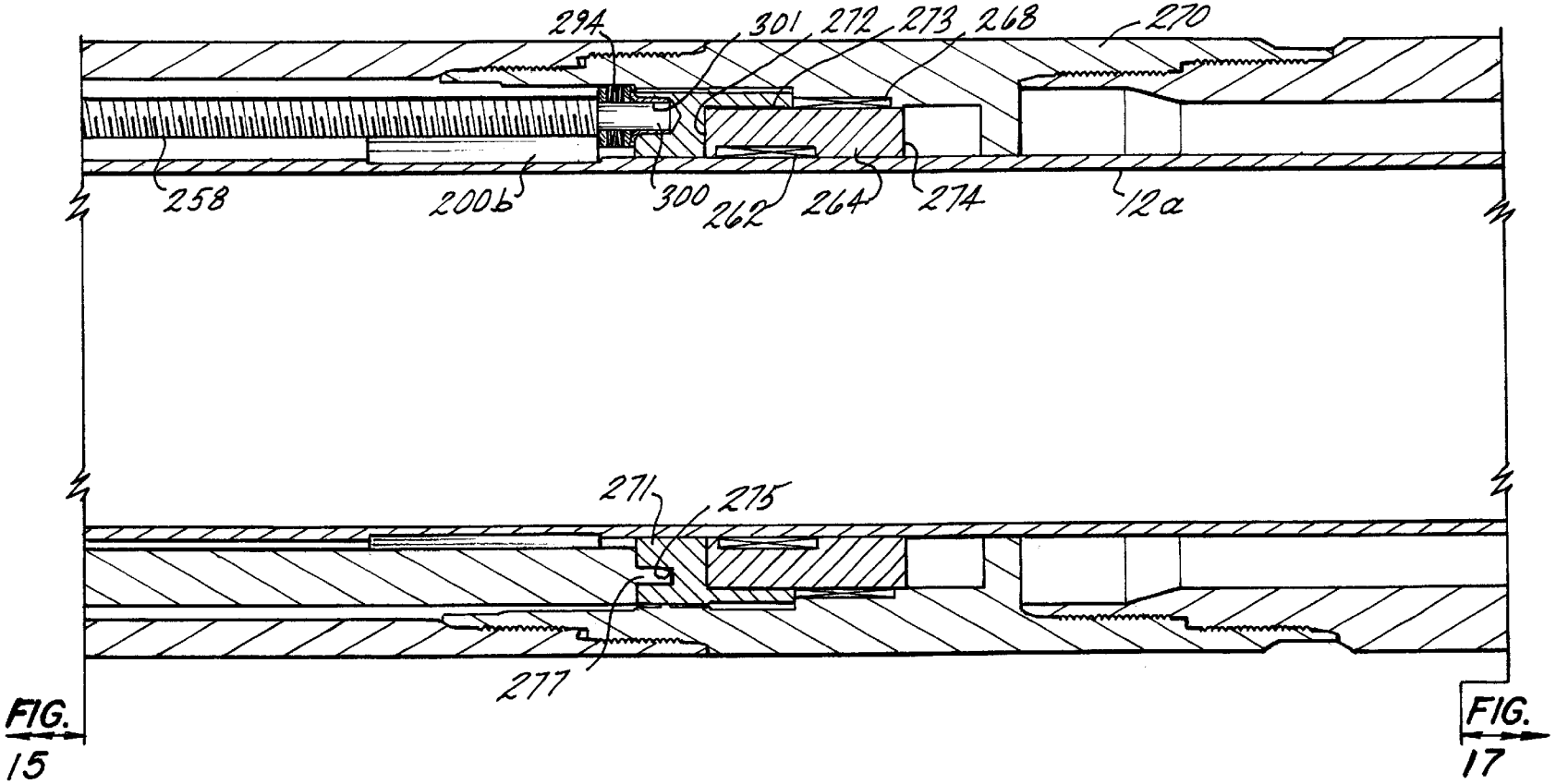
Figure 17:
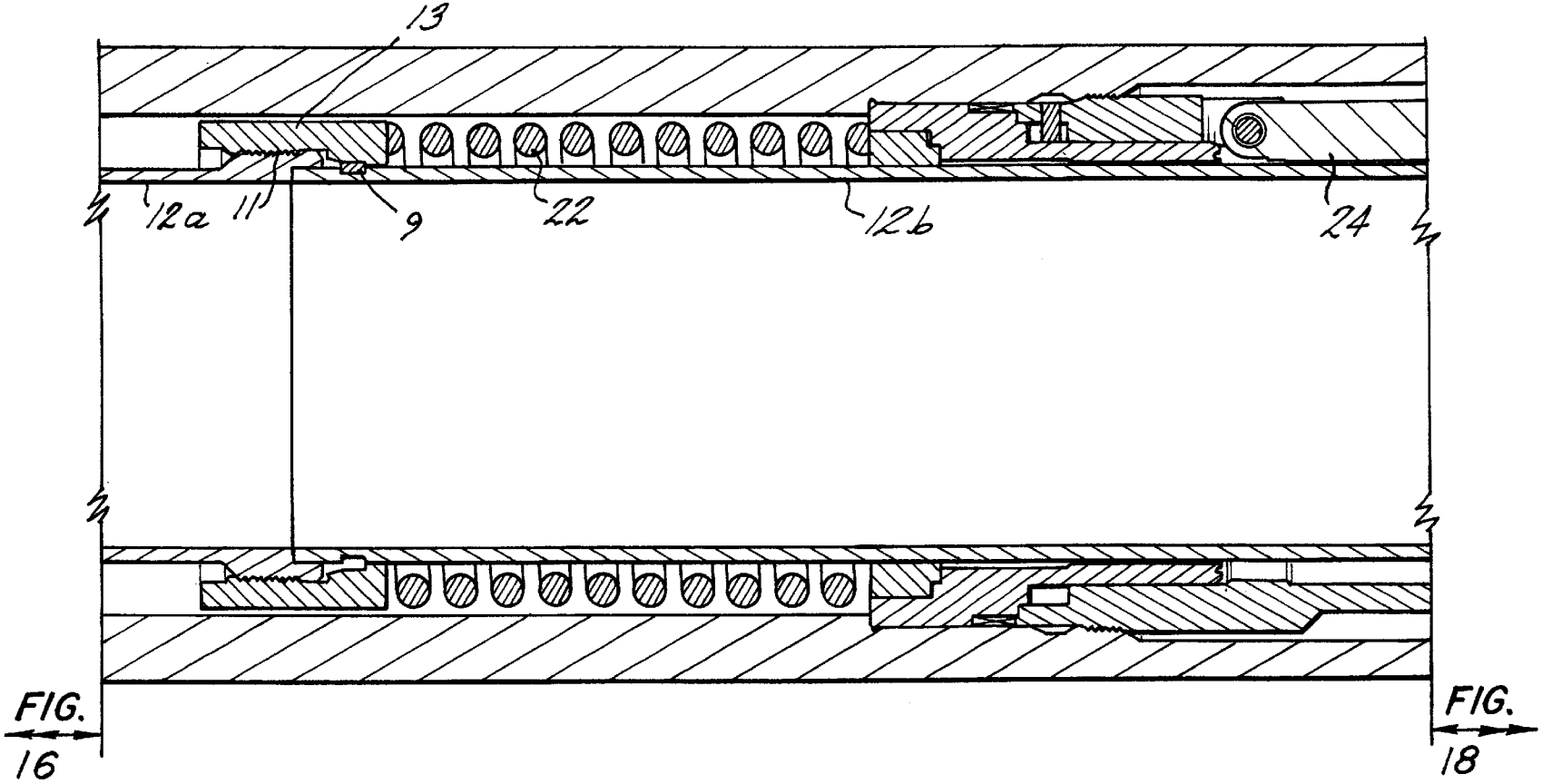
Figure 18:
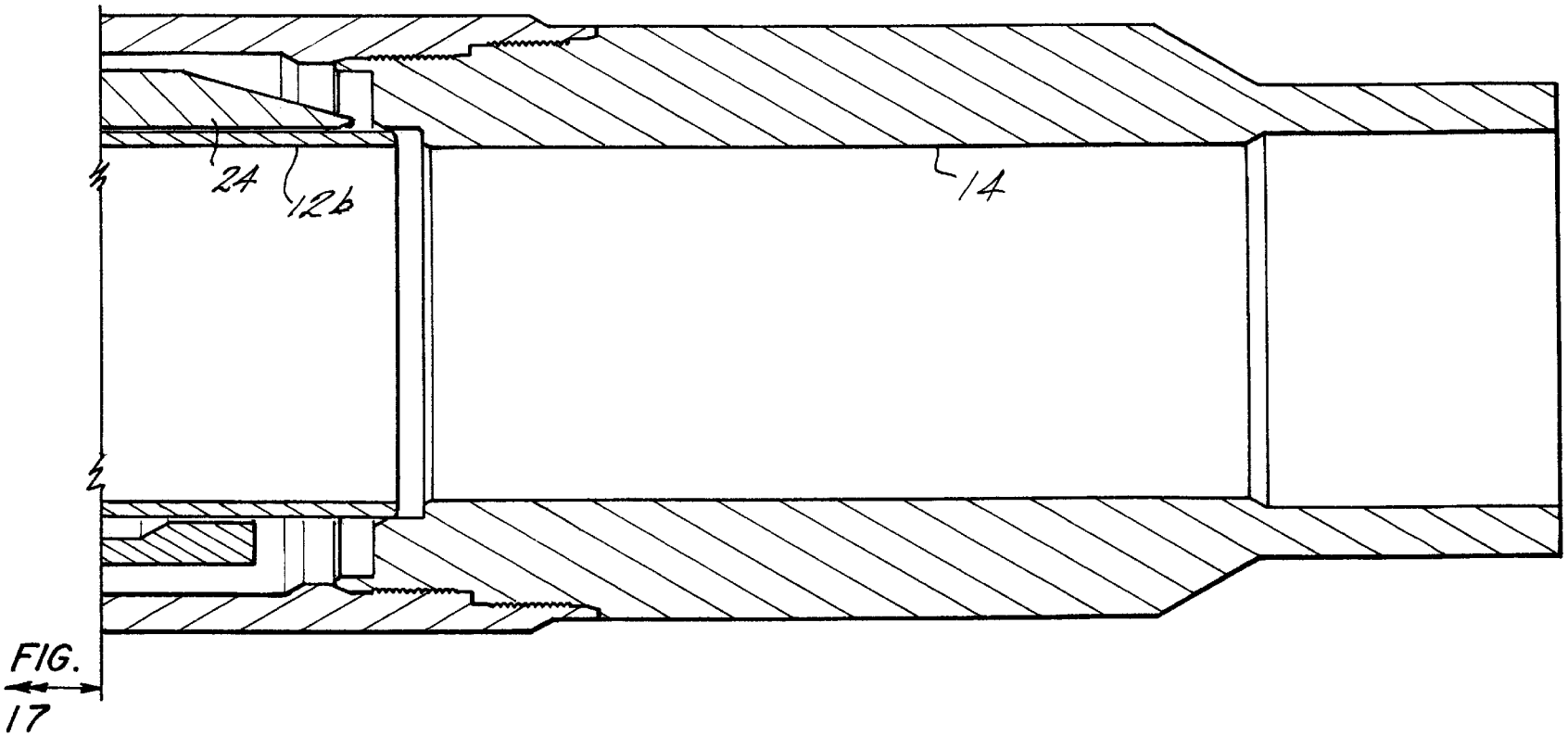
Figure 19:
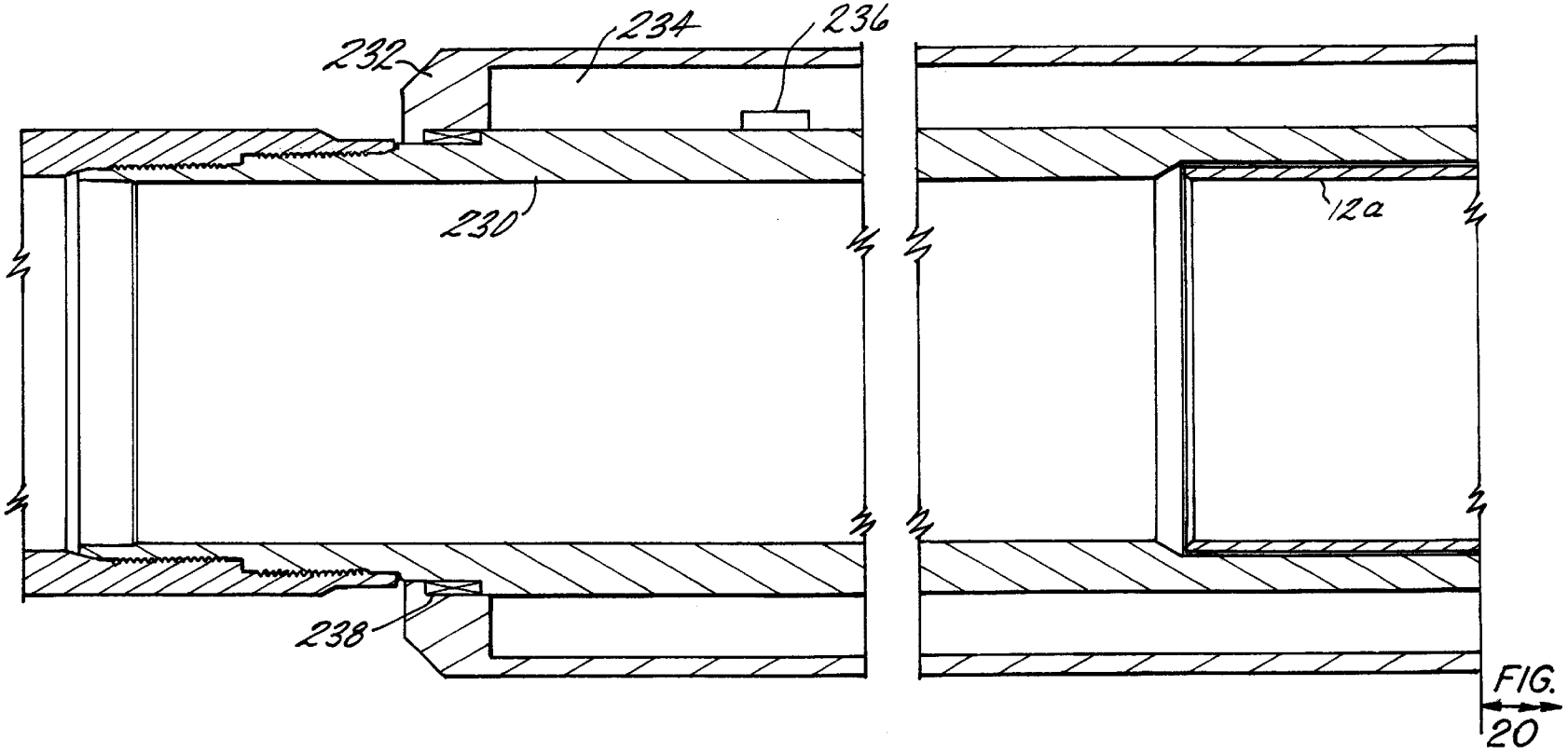
FIGS. 19–23 illustrates the embodiment of FIGS. 14–18 in another position.
Figure 20:
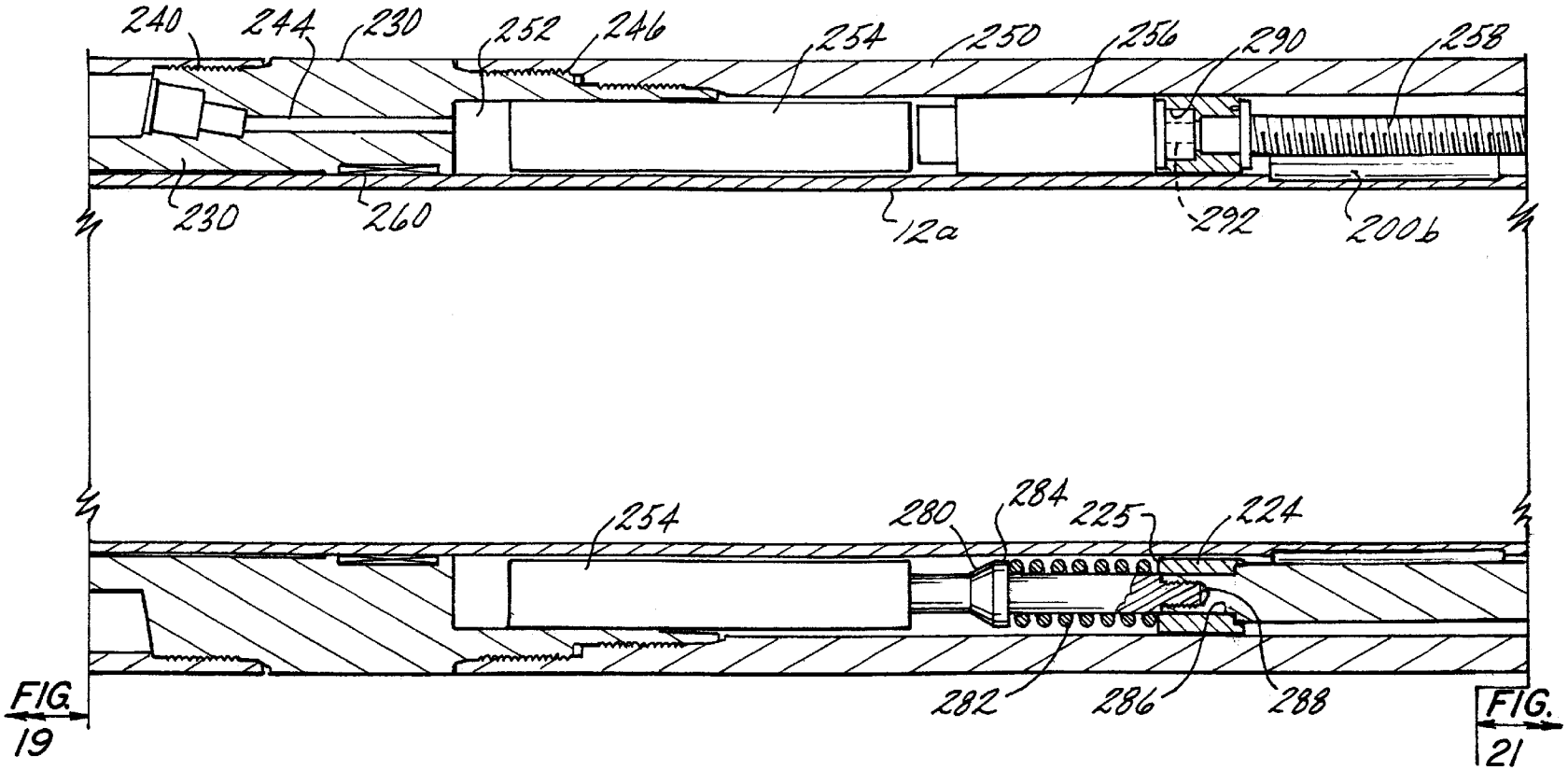
Figure 21:
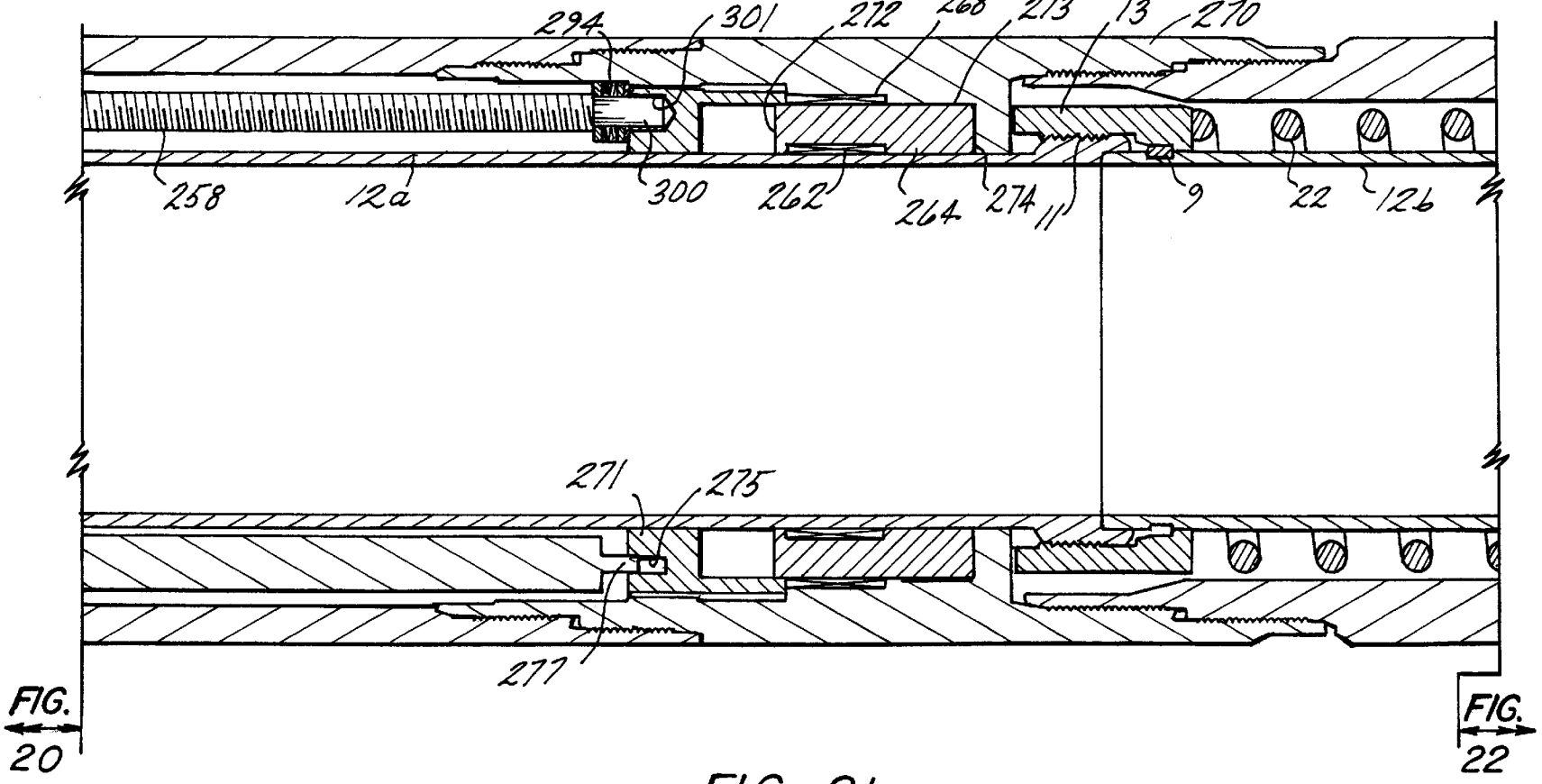
Figure 22:
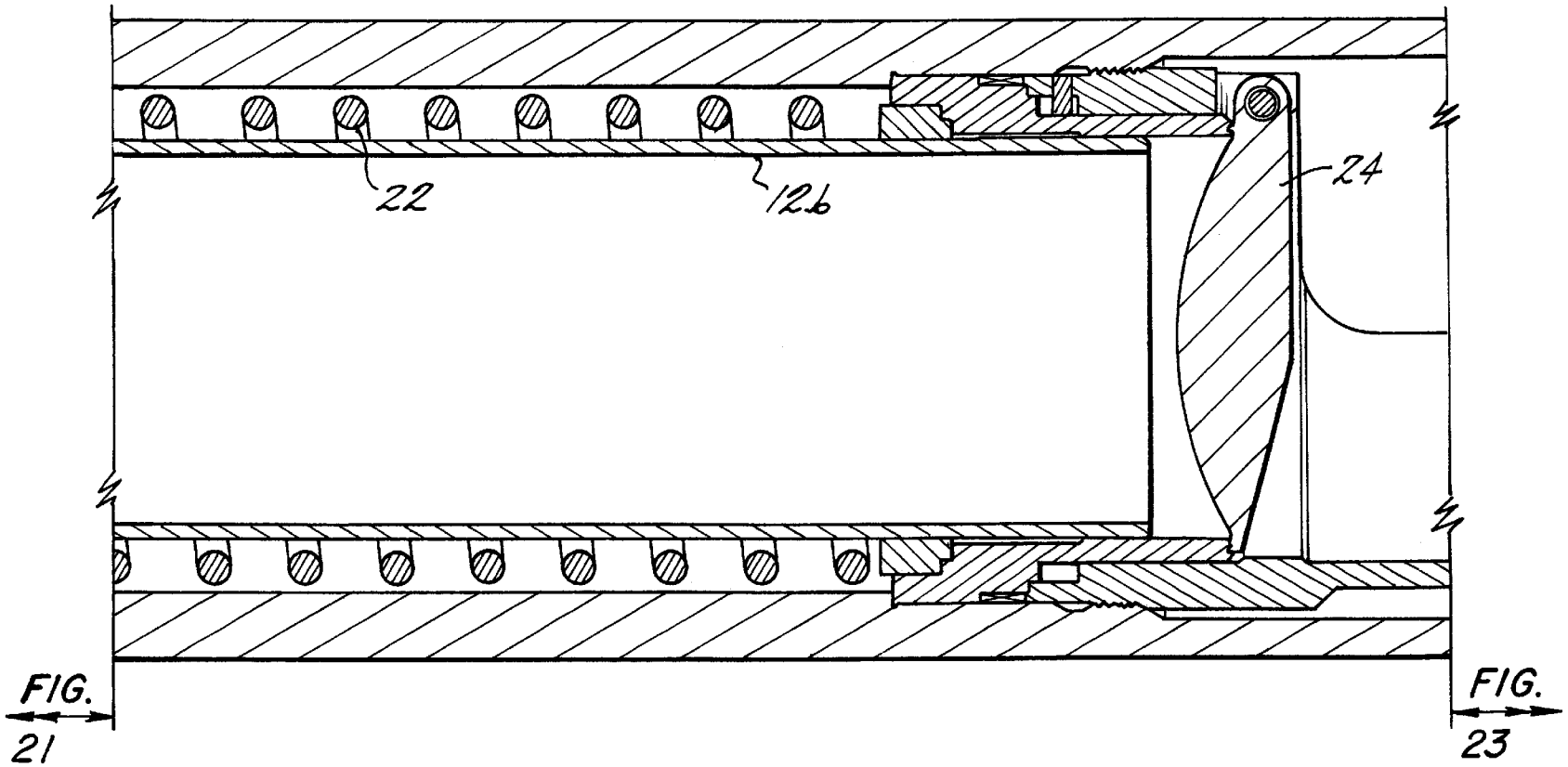
Figure 23:
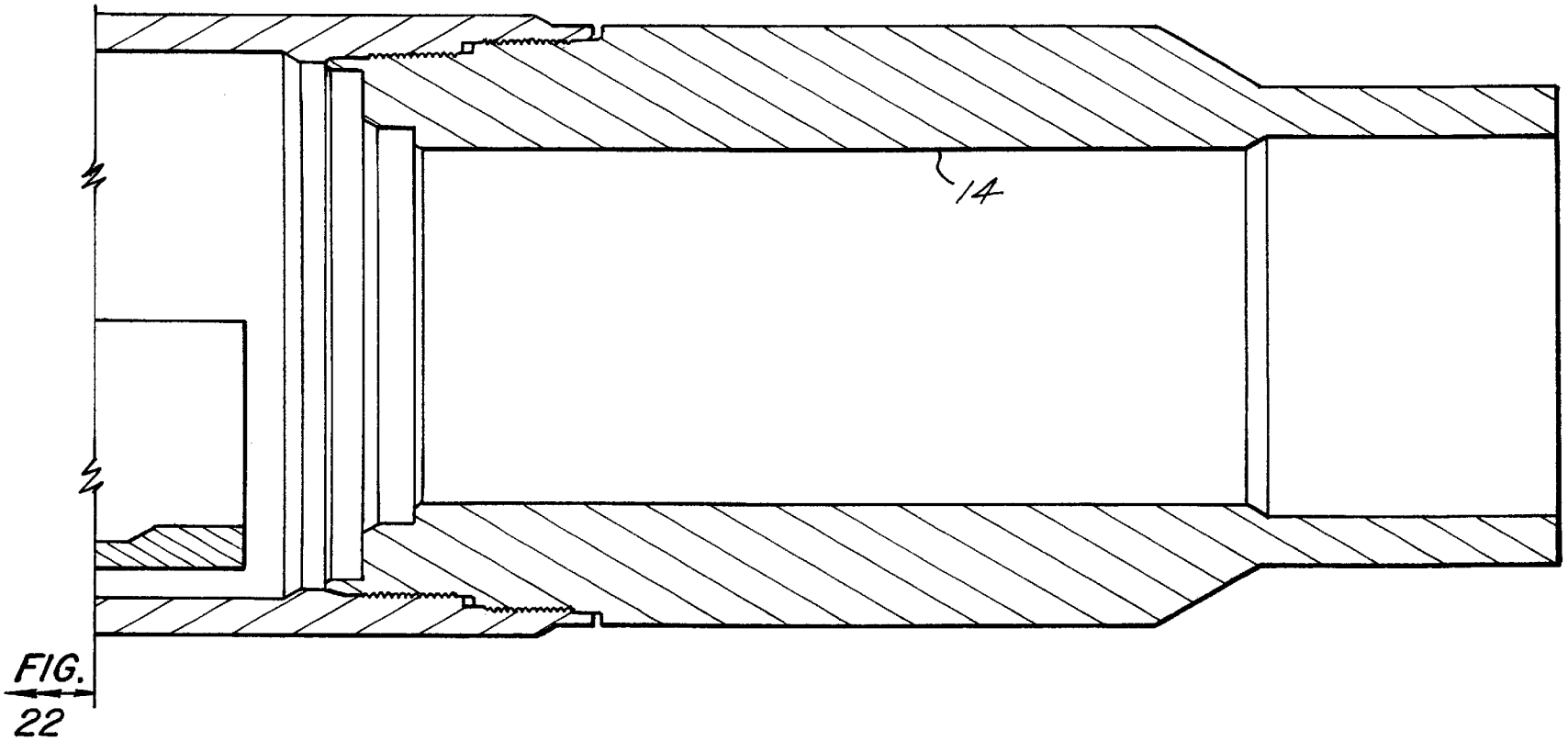

FIG. 13 is a cross-sectional side view of the embodiment of FIG. 8 in an engaged position. The solenoid 120 has been energized causing solenoid arm 122 to shift rod portion 104*b* relative to rod portion 104*a*. As rod portion 104*b* move relative to rod portion 104*a*, protrusions 124 move out of recesses 126 and contact the interior surface of rod portion 104*a*. This spreads the two rod portions apart, forcing the yoke halves 100*a* and 100*b* towards the lead screw 34. If power to the solenoid is interrupted, spring 128 shifts rod portion 104*b* so that protrusion 124 engage recesses 126 and the rod portions are in proximity of each other. This allows the yoke halves 100 to pull away from the lead screw 34 and assume a disengaged position as shown in FIG. 10. Springs 114 also tend to pull the yoke halves 100 away from the lead screw 34 to ensure disengagement. As mentioned above with respect to the previous embodiments, the motor 36 may be controlled from the surface or by a downhole controller 90.

Figure 24:
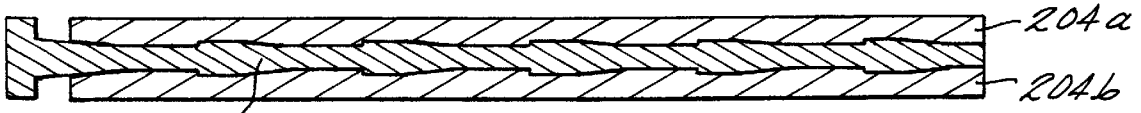
FIG. 24 is a view of the ramp and ramp follower of the invention in the retracted position.
Figure 25:
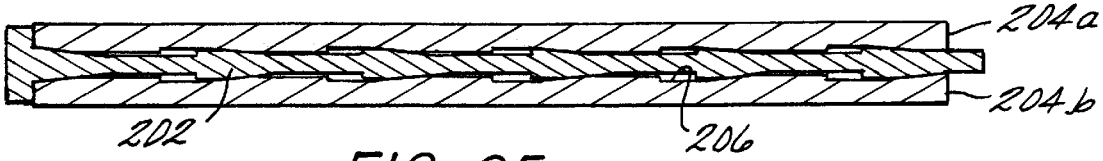
FIG. 25 is a view of the ramp and the ramp follower of the invention in the deployed position.

In yet another embodiment referring generally to FIGS. 14–27 of the present invention, yoke halves 200a and 200b are actuated by a single ramp 202 instead of the two split rods 104 as in the prior embodiment. A single ramp 202 is made functional regarding spreading by supplying two ramp followers 204*a* and 204*b*. Referring to FIGS. 24 and 25, the ramp and ramp followers of this embodiment are illustrated in the closed and spread positions, respectively. The ramp and ramp followers are preferably electric discharge machined from a single billet of material. This provides for a perfect match ensuring desired tolerances and reduces waste. Ramp surfaces 206 are preferably at about 10° of incline so that a full stroke causes ramp followers 204*a* and 204*b* to spread by about 30 to 50 and preferably about 40 thousandths (0.040) inch. Since this is approximately equivalent to the thread depth on the lead screw 34 and follower screws 42 it is all the movement that is necessary. It should be noted that a preferred thread angle for both the lead screw and the follower screws is 60°. This provides for both the depth of the thread desired and for yoke return as discussed hereunder.

Figure 26:
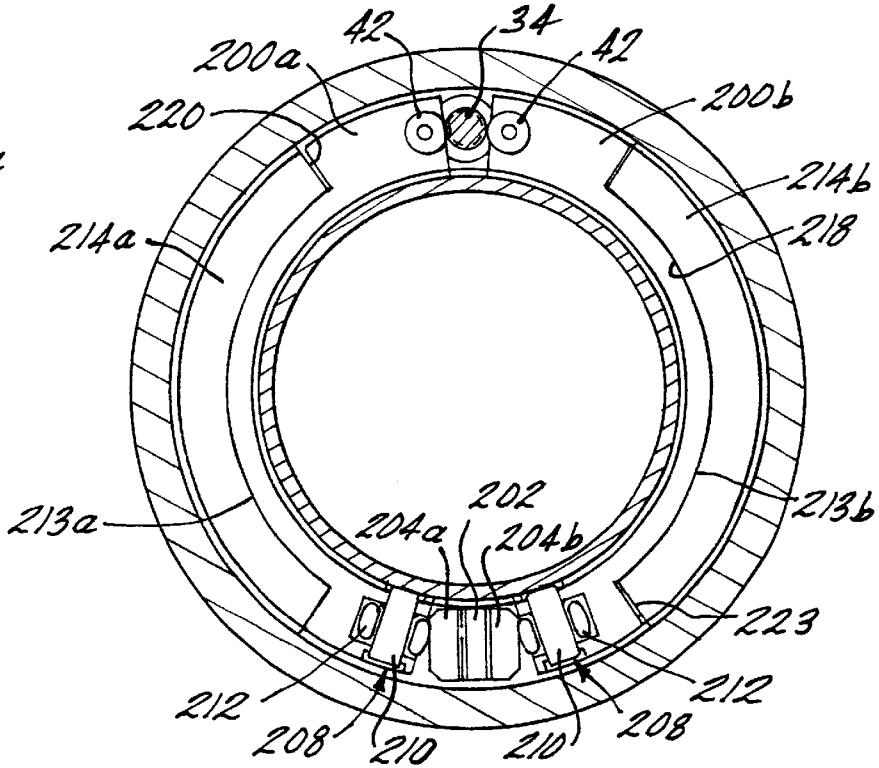
FIG. 26 is a cross-sectional view of the embodiment of FIGS. 14–18 taken along section line 26—26 in FIG. 21.

Referring to FIG. 26, outboard of ramp followers 204*a*/204*b* are rollers 208 comprising axel 210 and rotator 212. Axels 210 are mounted one in each yoke half 200*a*/200*b* at ends thereof opposite follower screws 42 which have been described herein before. Rotators 212 allow for low friction movement through the entire stroke of the safety valve of the invention. Also visible in the cross section view illustrated in FIG. 26, are the arms 214*a*/214*b* of cage 216. Cage 216 stabilizes yoke halves 200*a*/200*b* and directs their movement inwardly at the rocker arms 46. A machined surface 218 on the inside diameter of the cage is smooth and helps to translate the outward movement caused by the ramp followers to circumferential movement more smoothly. As will be appreciated, ramp 202 and ramp followers 204*a*/204*b* spread in a direction essentially straight out. Since yoke halves 200*a*/200*b* cannot move straight out due to interference of the (preferably smooth machined surfaces) cage arms 214*a*/214*b*, the movement is translated into circumferential movement to bring follower screws 42 into engagement with lead screw 34 in a movement direction opposite that of the ramp and ramp followers.

As is appreciated from Drawing FIG. 26, each yoke half 200*a*/200*b* is radially larger at its circumferential ends than at its circumferential center. This is to provide grooves 213*a*/213*b* in which the yoke halves may receive cage arms 214*a*/214*b*. This arrangement both adds substantial structural rigidity to the system, as well as minimizes diameter of the yoke system. An added benefit is that the arrangement facilitates assembly of the tool by allowing the yoke assembly to be assembled outside of the housing where access to the several parts is easier and then fit into the housing as a unit.

Figure 27:
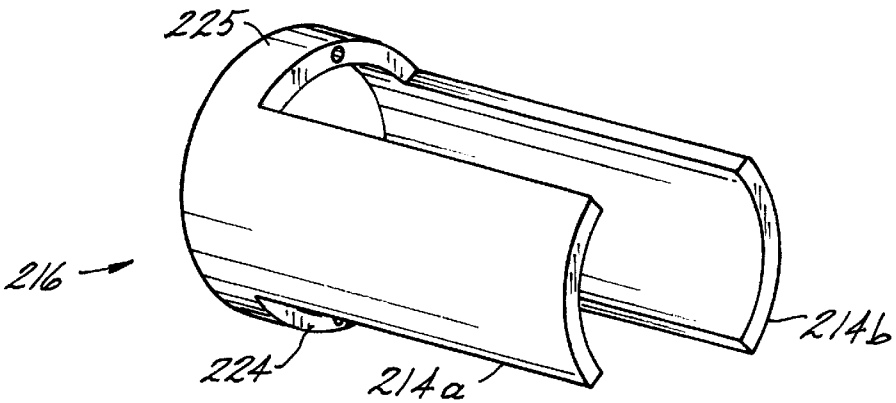
FIG. 27 is a perspective view of the cage of the embodiment of FIGS. 14–18.

FIG. 27 provides a perspective view of cage 216 to provide a better understanding to one of skill in the art of how an independent unit can be constructed which then can be installed in the housing. Ring 224 of cage 216 is structurally rigid and so holds arms 214*a*/214*b* rigidly. Assembly within the cage of the yoke halves 200*a*/200*b* with a ramp 202 and ramp followers 204*a*/204*b* is a simple matter. Once the parts are combined, they are easily installed in the housing of the tool.

The circumferential length of grooves 213*a*/213*b* is slightly larger than the circumferential length of arms 214*a*/214*b* so that each yoke half may be moved into engagement and out of engagement with lead screw 34. It should be appreciated that in FIG. 26 the left yoke half 200*a* is illustrated in the engaged position and the right yoke half 200*b* is illustrated in the disengaged position. It will be understood that the invention does not preferably operate in this configuration but is illustrated in this way for clarity of understanding. Reviewing FIG. 26, will reveal a gap 220 at the upper part of the FIGURE for the engaged yoke half and a gap 220 at the lower part of the FIGURE for the disengaged yoke half. The gaps illustrate the amount of travel which preferably is in the range of about 30 to about 50 thousandths of an inch. In a preferred arrangement, the gap 220 further includes a leaf spring having sufficient force of preferably about 25 pounds of force stored therein to assist in disengaging the yoke halves from lead screw 34. The end of the leaf spring 223 is illustrated in the FIGURE and will teach the location and orientation of the spring to one of ordinary skill in the art. The spring is located with its long axis parallel to the axis of the tool and the concave/convex sides of the spring are oriented one facing the cage arm and one facing the yoke half. It is not material which one faces which way. Although the leaf spring 223 is preferred, another preferred arrangement does not employ the leaf spring 223. In this embodiment the flank angle on the lead screw 34 and follower screws 42 of preferably 60° provides a significant yoke disengagement force and is capable of providing sufficient disengagement for the safety valve power spring to close the flapper by bringing the yoke back uphole. Thus in this embodiment the flank angle selected for the lead screw and follower screws is important to the invention.

Referring to FIGS. 14–23 the above discussed features of the invention are illustrated in communication and cooperation with the rest of the safety valve of the embodiment. As will be appreciated by one of skill in the art, the drawings illustrate the tool with the uphole end on the left of the drawing.

The terms "uphole" and "downhole" as used herein refer to relative positions of features of the preferred embodiment which could be reversed in some cases as desired. Beginning with FIG. 14, an electronics sub 230 having an electronics cover 232 thereon and in sealed relationship therewith define an atmospheric chamber 234 which houses an electronics package 236 and protects it from damage downhole and while running the tool. Electronics cover 232 includes a standard known seal 238 to help maintain atmospheric pressure within atmospheric chamber 234. Cover 232 is connected with sub 230 at the downhole end preferably by a threaded connection 240 and sealed at the uphole end by a soft seal. Since electronics package 236 requires information flow, a port 244 is provided in electronics sub 230 to run electrical connectors (not shown) to other electrical systems of the invention. Connection port 244 is known to the industry.

Electronics sub 230 is connected preferably by a threaded connection 246 to tool housing 250. Housing 250 encloses an annular space 252 preferably filled with a suitable, art recognized, dielectric fluid (not shown) to protect an annular solenoid 254, motor and reducer 256, lead screw 258, yoke halves 200*a*/200*b* (and associated parts) and cage 216. The dielectric fluid protects and lubricates these parts to avoid scale and other buildup that would otherwise occur in the downhole environment if the parts were exposed to wellbore fluids.

In order to have a dielectric fluid be maintained separately from wellbore fluid the annular space must obviously be bounded radially inwardly by another structure. This structure is flow tube 12 which is similar to the first embodiment of the invention. Flow tube 12 is sealed at the uphole end of the tool housing by a dynamic seal 260 located in electronics sub 230 near annular space 252. At the downhole end of the annular space 252 the flow tube is sealed with another dynamic seal 262 of the same diameter as seal 260 in a compensator piston 264. Maintaining the diameter of the seals equivalent prevents the flow tube from becoming an annular piston itself. As will be understood, another dynamic seal is then needed due to movement capability of the piston 264. This is dynamic seal 268 which is mounted in compensator housing 270 discussed hereunder. The two seals 262 and 268 allow longitudinal movement of both the flow tube 12 and the compensator piston independently of one another, as indeed they do move in this way, while still maintaining a fluid seal for the dielectric fluid in space 252.

The uphole end 272 of compensator piston 264 is exposed to the dielectric fluid in space 252 while the downhole end 274 of piston 264 is exposed to ambient pressure. This arrangement allows the pressure and temperature differential downhole from surface pressure and temperature to be compensated for in the enclosed dielectric fluid space. More specifically, as the pressure downhole increases the piston 264 is forced to move toward space 252 and increases the pressure thereof to equal ambient pressure. As the temperature in the downhole environment increases with depth of the tool, the piston is able to move in the other direction to allow for expansion of the dielectric fluid in the closed system. As one of skill in the art will readily understand the uphole and downhole ends of the piston and the location of the piston may be varied without departing from the scope of the invention.

Returning to the operable parts of the invention contained within the dielectric fluid, reference is made to FIGS. 15,16,20 and 21. Solenoid 254 is preferably annularly shaped to extend around flow tube 12 in annular space 252. Solenoid 254 is operably connected to ramp 202 and functions to push ramp 202 downhole thereby urging ramp followers 204*a*/204*b* outwardly as discussed above. The throw distance of solenoid 254 is preferably about 0.2 inch but is related to the angle of the ramped surfaces 206 and the total spreading desired. A higher angle of the ramp surfaces will require less throw from solenoid 254 to engage follower screws 42 with lead screw 34 as discussed; a lesser angle will require more throw. Preferably, the angle is about 10° which then corresponds to the preferred throw distance noted above.

Solenoid 254 is in operable communication with spring mandrel 280 and may actually be attached thereto or may simply bear upon the uphole end thereof since solenoid 254 does not provide any tensile loading but rather only provides compressive loading on spring mandrel 280. Movement of mandrel 280 in the uphole direction is caused by spring 282 bearing upon spring collar 284 of spring mandrel 280 and an uphole surface 225 of cage ring 224 which is fixedly located within tool housing 250. Upon energization of solenoid 254, spring mandrel 280 is urged downhole to activate ramp 202 in the manner discussed hereinabove. Upon deenergization of Solenoid 254, spring 282 urges the ramp 202 into its rest position. This action is made possible by a fixed connection 288 between mandrel 280 and ramp 202 which may be threaded or any other fixed connection. Cage ring 224 allows the connection through a hole 286 bored therein. Whether deenergization of solenoid 254 is intentional, accidental or in response to a signal received by electronics package 236 from the surface or a controller at the surface or downhole, the result is the same. Upon deenergization, spring 282 urges ramp 202 uphole removing support for yoke halves 200*a*/200*b* . The yoke is thus moved away from the lead screw 34, disengaged therefrom and allows the power spring of the safety valve discussed in the first embodiment of the invention to move the flow tube uphole and close the safety valve flapper.

Referring again to FIG. 15, and to a different portion of annular space 252, a motor and reducer (and resolver if a brushless motor is employed; resolver is not necessary with a brush-type motor) assembly 256 is illustrated in space 252. Motor/reducer/resolver is mounted fixedly to cage ring 224. Cage ring 224 provides a through hole 290 so the motor 256 may access and be operably attached to lead screw 258 via motor shaft 292. Motor/reducer/resolver 256 is energized when desired or programmed by electronics package 236 to turn lead screw 258. Lead screw 258 is supported as its downhole end 300 by a pilot hole 301 in cage end 271 which is bolted to cage arms 214*a*/214*b* and is threadedly connected to compensator housing 270 by threaded connection 273 . A further hole 275 is provided to accept nose 277 of ramp 202.

In addition to turning lead screw 258, motor assembly 256 also includes an electronically activated brake to hold lead screw 258 in a particular position after having turned the predetermined number of times. The brake is necessary because in order to make the safety valve fail safe, the power spring 22 is selected to be strong enough to cause lead screw 258 to back drive when the motor is not turning. The selected strength takes into account the drag of the motor and reducer turning backward, friction of the flow tube dynamic seals 260 and 262, scale and paraffin buildup in the components of the device and all of the weight of the moving parts of the device. Determining the strength of the spring needed to overcome the noted parts is a matter known to one of ordinary skill in the art. Because of this, if the brake is not supplied the safety valve will not remain open. It should be noted that the entire motor assembly including the electronically activated brake is available commercially from Astro Instruments Corporation, Deerfield, Fla. Compensator housing 270 is then threadedly connected to valve housing 302 which is as it was in the prior art and generally as discussed above. One of skill in the art will appreciate that all of the components within valve housing 302 and illustrated in FIGS. 17,18, 22 and 23 are known to the art as a prior art safety valve which is commercially available from Baker Oil Tools, Broken Arrow, Okla. These parts are illustrated in the FIGURES noted only for the sake of completeness.

An additional feature provided to prevent damage to the motor 256 (see FIG. 16) in the event it does not turn off when intended is dampener spring 294. Spring 294 is disposed upon lead screw 258 at a downhole end thereof and functions to create a progressively greater electrical draw on motor 256 if the yoke 200 has traveled too far downhole. This is simply due to progressive resistance on the yoke as the spring is compressed. The electronics package 236 is preferably equipped to sense current draw and shut down the motor if the draw gets higher than a predetermined point.

One of skill in the art will appreciate that downhole of those sections discussed, and as illustrated in FIGS. 17,18, 22 and 23, the valve structure illustrated is a prior art safety valve that is commercially available from Baker Oil Tools, Broken Arrow, Okla. except for the preferred arrangement of flow tube 12. In this embodiment the tube is in two pieces 12*a* and 12*b* for ease of assembly of the tool. Spring stop 13 includes threaded connection 11 and snap ring 9 to connect tubes 12*a* and 12*b*. The assembly of these items in this manner is known to one of skill in the art.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A safety valve and actuator comprising:

a driver mounted to said safety valve such that said driver selectively drives a flow tube to open said safety valve;

a yoke system selectively engageable and disengageable with said driver, and said flow tube of said safety valve being connected with said yoke system so as to be axially moveable thereby said yoke system comprising two yoke halves, each half having a first and second circumferential end, each half having a driver engager on said first circumferential end and being in operable communication with at least one yoke shifter at said second circumferential end, said at least one yoke shifter being selectively activateable whereby each of said yoke halves are biased into a predetermined position wherein said driver engager on each yoke half is engaged with said driver.

2. The safety valve and actuator as claimed in claim 1 wherein said at least one yoke shifter is a ramp and at least one ramp follower, said ramp being longitudinally displaceable to cause said ramp and said at least one ramp follower to spread apart.

3. The safety valve and actuator as claimed in claim 2 wherein said at least one ramp follower is two ramp followers, one disposed on either longitudinal side of said ramp.

4. The safety valve and actuator as claimed in claim 3 wherein said ramp is actuatable by a solenoid.

5. The safety valve and actuator as claimed in claim 3 wherein said second circumferential ends of said yoke halves include rollers reducing friction between said second circumferential ends and said ramp followers.

6. The safety valve and actuator as claimed in claim 1 wherein said at least one yoke shifter is a selectively rotatable cam disposed between said second circumferential ends of said yoke halves.

7. The safety valve and actuator as claimed in claim 1 wherein said yoke system further comprises:

a cage having a cage ring and two cage aims extending in parallel with one another and axially to said ring; and grooves in each of said two yoke halves, said grooves being sized to nest with said cage arms, said cage arms being circumferentially shorter than said grooves so that said yoke halves are circumferentially displaceable relative to said arms while being retained in predetermined positions by said arms.

8. The safety valve and actuator as claimed in claim 1 wherein said yoke halves are each at least one of slidably and rotatably mounted on pins to maintain said yoke halves in predetermined positions.

9. The safety valve and actuator as claimed in claim 1 wherein said driver is a lead screw assembly comprising a lead screw and a motor operably attached at one axial end of said lead screw to selectively rotate said lead screw axially.

10. The safety valve and actuator as claimed in claim 9 wherein said lead screw assembly further includes a counter to limit the number of turns of said lead screw before said motor is halted.

11. The safety valve and actuator as claimed in claim 9 wherein said lead screw includes a dampener spring at an axial end of said lead screw opposite said motor.

12. A safety valve comprising:

a housing;

a flow tube within said housing;

a flapper mounted to said housing and openable by said flow tube upon axial movement of said flow tube towards said flapper;

a spring disposed outside of said flow tube and within said housing, said spring biasing said flow tube away from said flapper to close said flapper;

a yoke system having a yoke connected to said flow tube, said yoke being selectively engageable and disengageable with a lead screw driven by a motor mounted in said housing, said yoke being engageable with said lead screw by a ramp and ramp follower system having at least one ramp follower which biases said yoke into engagement with said lead screw;

a solenoid mounted in said housing and in operable communication with said ramp and ramp follower system, said solenoid longitudinally displacing said ramp to laterally displace said at least one ramp follower whereby said yoke is engaged with said lead screw, said yoke being moved downhole with said lead screw and urging said flow tube toward said flapper to open said flapper.

* * * * *

UNITED STATES PATENT AND TRADEMARK OFFICE

CERTIFICATE OF CORRECTION

PATENT NO. : 6,253,843 B1
DATED : July 3, 2001
INVENTOR(S) : Rawson et al.

It is certified that error appears in the above-identified patent and that said Letters Patent is hereby corrected as shown below:

Column 1,
Line 46, after "column" insert therefor -- to move --

Column 2,
Line 47, after "reduced" insert therefor -- , --

Column 3,
Line 1, after "3B" delete "is" and insert therefor -- are --
Line 3, after "a" delete "cross-section" and insert therefor -- cross-sectional --
Line 7, after "merely" delete "with"
Line 26, after "are" delete "an"
Line 26, after "elongated" delete "view" and insert therefor -- views --
Line 28, after "19-23" delete "illustrates" and insert therefor -- illustrate --
Line 43, after "PREFERRED" delete "EMBODIMENT" and insert therefor
-- EMBODIMENTS --

Column 5,
Line 48, after "32b" delete "ride" and insert therefor -- rides --
Line 54, after "shoulder" delete "140" and insert therefor -- 132 --

Column 6,
Line 28, after "halves" delete "100" and insert therefor -- 100a,b --
Line 41, after "124" delete "and" and insert therefor -- are --
Line 44, after "FIG. 13)" delete "the" and insert therefor -- that --

Column 7,
Line 2, after "104b" delete "move" and insert therefor -- moves --
Line 8, after "124" delete "engage" and insert therefor -- engages --
Lines 10 and 12, after "halves" delete "100" and insert therefor -- 100 a, b --
Line 42, after "described" delete "herein before" and insert therefor -- hereinabove --
Line 57, after "from" delete "Drawing"
Line 66, after "then" delete "fit" and insert therefor -- fits --

Column 8,
Line 19, after "26" delete ","

Column 9,
Line 52, after "the" (second occurrence) delete "ramped" and insert therefor -- ramp --

UNITED STATES PATENT AND TRADEMARK OFFICE

CERTIFICATE OF CORRECTION

PATENT NO. : 6,253,843 B1
DATED : July 3, 2001
INVENTOR(S) : Rawson et al.

It is certified that error appears in the above-identified patent and that said Letters Patent is hereby corrected as shown below:

Column 10,
Line 3, after "of" delete "Solenoid" and insert therefor -- solenoid --
Line 61, before "is" delete "intended" and insert therefor -- intended, --

Column 11,
Line 34, after "halves" delete "are" and insert therefor -- is --

Column 12,
Line 3, after "cage" (third occurrence) delete "aims" and insert therefor -- arms --

Signed and Sealed this

First Day of March, 2005

JON W. DUDAS
*Director of the United States Patent and Trademark Office*